US009392835B2

(12) United States Patent
Dekovic et al.

(10) Patent No.: US 9,392,835 B2
(45) Date of Patent: Jul. 19, 2016

(54) ARTICLE OF FOOTWEAR INCORPORATING A KNITTED COMPONENT WITH AN INTEGRAL KNIT ANKLE CUFF

(71) Applicant: NIKE, Inc., Beaverton, OR (US)

(72) Inventors: Denis Dekovic, Portland, OR (US); John Droege, Portland, OR (US); Windra Fahmi, Beaverton, OR (US); Jeongwoo Lee, Portland, OR (US); Daniel A. Podhajny, Beaverton, OR (US); Karl Seamarks, Portland, OR (US); Doug D. Wilken, Hillsboro, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 14/574,486

(22) Filed: Dec. 18, 2014

(65) Prior Publication Data

US 2015/0101212 A1 Apr. 16, 2015

Related U.S. Application Data

(63) Continuation of application No. 14/013,446, filed on Aug. 29, 2013.

(51) Int. Cl.
*A43B 1/02* (2006.01)
*A43B 1/04* (2006.01)
(Continued)

(52) U.S. Cl.
CPC ... *A43B 1/04* (2013.01); *A43B 5/02* (2013.01); *A43B 7/20* (2013.01); *A43B 23/02* (2013.01);
(Continued)

(58) Field of Classification Search
CPC ..... A43B 1/04; A43B 23/02; A43B 17/003; A43B 23/0235; A43B 23/0275; A43B 23/0205; A43B 23/042; A43B 23/024; A43B 7/20; A43B 5/02; D04B 1/106; D10B 2403/032; D10B 2501/043
USPC ..... 36/84; 66/177, 196, 64; 2/239
See application file for complete search history.

(56) References Cited

U.S. PATENT DOCUMENTS

RE7,921 E 10/1877 Robinson, Jr.
601,192 A 3/1898 Woodside
(Continued)

FOREIGN PATENT DOCUMENTS

DE 870963 C 3/1953
DE 1084173 6/1960
(Continued)

OTHER PUBLICATIONS

Marguerite, Stitches of Violet:Carol's Old Shale Two Yarn Sock, Dec. 28, 2004.*
(Continued)

*Primary Examiner* — Clinton T Ostrup
*Assistant Examiner* — Abby Spatz
(74) *Attorney, Agent, or Firm* — Brinks Gilson & Lione

(57) ABSTRACT

An article of footwear with a knitted component including an upper and an integral knit ankle cuff is provided. The upper and the ankle cuff are formed as a one-piece knit element. The knit element forms a portion of an exterior surface of the upper and an opposite interior surface of the upper, with the interior surface forming a void for receiving a foot. The ankle cuff is formed of unitary knit construction with the upper as a one-piece knit element and extends above a throat area of the upper. The ankle cuff includes malleolus zones on medial and lateral sides to correspond with the ankle bones of a wearer. The knit component further incorporates features to assist with providing entry for a foot of a wear, providing comfort to a wearer, and to assist with orientation of the upper of the article of footwear when being worn.

20 Claims, 18 Drawing Sheets

(51) Int. Cl.

| | |
|---|---|
| ***A43B 23/02*** | (2006.01) |
| ***A43B 5/02*** | (2006.01) |
| ***A43B 7/20*** | (2006.01) |
| ***A43B 23/04*** | (2006.01) |
| ***D04B 1/10*** | (2006.01) |

(52) U.S. Cl.

CPC ..... *A43B 23/024* (2013.01); *A43B 23/0205* (2013.01); *A43B 23/0235* (2013.01); *A43B 23/0275* (2013.01); *A43B 23/042* (2013.01); *D04B 1/106* (2013.01); *D10B 2403/032* (2013.01); *D10B 2501/043* (2013.01)

(56) References Cited

U.S. PATENT DOCUMENTS

| | | | | |
|---|---|---|---|---|
| 797,743 | A | | 8/1905 | McCoy |
| 1,215,198 | A | | 2/1917 | Rothstein |
| 1,504,043 | A | | 1/1924 | Hidock |
| 1,597,934 | A | | 8/1926 | Stimpson |
| 1,888,172 | A | | 11/1932 | Joha |
| 1,902,780 | A | | 3/1933 | Holden et al. |
| 1,910,251 | A | | 5/1933 | Joha |
| 2,001,293 | A | | 5/1935 | Wilson |
| 2,047,724 | A | | 7/1936 | Zuckerman |
| 2,147,197 | A | | 2/1939 | Glidden |
| 2,314,098 | A | | 3/1943 | McDonald |
| 2,330,199 | A | | 9/1943 | Basch |
| 2,343,390 | A | | 3/1944 | Ushakoff |
| 2,400,692 | A | | 5/1946 | Herbert |
| 2,440,393 | A | | 4/1948 | Clark |
| 2,569,764 | A | | 10/1951 | Jonas |
| 2,586,045 | A | | 2/1952 | Hoza |
| 2,608,078 | A | | 8/1952 | Anderson |
| 2,641,004 | A | | 6/1953 | Whiting et al. |
| 2,675,631 | A | | 4/1954 | Doughty |
| 2,934,839 | A | | 5/1960 | Servin |
| 2,994,322 | A | | 8/1961 | Cullen et al. |
| 3,694,940 | A | | 10/1972 | Stohr |
| 3,704,474 | A | | 12/1972 | Winkler |
| 3,766,566 | A | | 10/1973 | Tadokoro |
| 3,778,856 | A | | 12/1973 | Christie et al. |
| 3,583,081 | A | | 6/1974 | Hayashi |
| 3,952,427 | A | | 4/1976 | Von den Benken et al. |
| 3,972,086 | A | | 8/1976 | Belli et al. |
| 4,027,402 | A | | 6/1977 | Liu et al. |
| 4,031,586 | A | | 6/1977 | Von den Benken et al. |
| 4,211,806 | A | | 7/1980 | Civardi et al. |
| 4,232,458 | A | | 11/1980 | Bartels |
| 4,255,949 | A | | 3/1981 | Thorneburg |
| 4,258,480 | A | | 3/1981 | Famolare, Jr. |
| 4,317,292 | A | | 3/1982 | Melton |
| 4,373,361 | A | | 2/1983 | Thorneburg |
| 4,397,161 | A | * | 8/1983 | Chesebro et al. ..... 66/178 A |
| 4,447,967 | A | | 5/1984 | Zaino |
| 4,451,996 | A | | 6/1984 | Norton et al. |
| 4,465,448 | A | | 8/1984 | Aldridge |
| 4,494,388 | A | * | 1/1985 | Lau ..... D04B 1/265 66/169 A |
| 4,607,439 | A | | 8/1986 | Sogabe et al. |
| 4,615,188 | A | * | 10/1986 | Hursh et al. ..... 66/196 |
| 4,737,396 | A | | 4/1988 | Kamat |
| 4,750,339 | A | | 6/1988 | Simpson et al. |
| 4,756,098 | A | | 7/1988 | Boggia |
| 4,785,558 | A | | 11/1988 | Shiomura |
| 4,813,158 | A | | 3/1989 | Brown |
| 5,031,423 | A | | 7/1991 | Ikenaga |
| 5,095,720 | A | | 3/1992 | Tibbals, Jr. |
| 5,117,567 | A | | 6/1992 | Berger |
| 5,152,025 | A | | 10/1992 | Hirmas |
| 5,185,000 | A | | 2/1993 | Brandt et al. |
| 5,192,601 | A | | 3/1993 | Neisler |
| 5,345,638 | A | | 9/1994 | Nishida |
| 5,353,524 | A | | 10/1994 | Brier |
| 5,371,957 | A | | 12/1994 | Gaudio |
| 5,421,034 | A | | 6/1995 | Keune |
| 5,461,884 | A | | 10/1995 | McCartney et al. |
| 5,511,323 | A | | 4/1996 | Dahlgren |
| 5,572,860 | A | | 11/1996 | Mitsumoto et al. |
| 5,575,090 | A | | 11/1996 | Condini |
| 5,623,840 | A | | 4/1997 | Roell |
| 5,729,918 | A | | 3/1998 | Smets |
| 5,735,145 | A | | 4/1998 | Pernick |
| 5,746,013 | A | | 5/1998 | Fay, Sr. |
| 5,765,296 | A | | 6/1998 | Ludemann et al. |
| 5,778,500 | A | | 7/1998 | Illingworth |
| 5,884,419 | A | | 3/1999 | Davidowitz et al. |
| 5,996,189 | A | | 12/1999 | Wang |
| 6,029,376 | A | | 2/2000 | Cass |
| 6,032,387 | A | | 3/2000 | Johnson |
| 6,052,921 | A | | 4/2000 | Oreck |
| 6,088,936 | A | | 7/2000 | Bahl |
| 6,151,802 | A | | 11/2000 | Reynolds |
| 6,170,175 | B1 | | 1/2001 | Funk |
| 6,308,438 | B1 | | 10/2001 | Throneburg et al. |
| 6,333,105 | B1 | | 12/2001 | Tanaka et al. |
| 6,401,364 | B1 | | 6/2002 | Burt |
| 6,558,784 | B1 | | 5/2003 | Norton et al. |
| 6,588,237 | B2 | | 7/2003 | Cole et al. |
| 6,754,983 | B2 | | 6/2004 | Hatfield et al. |
| 6,895,696 | B1 | | 5/2005 | Sanders |
| 6,910,288 | B2 | | 6/2005 | Dua |
| 6,922,917 | B2 | | 8/2005 | Kerns et al. |
| 6,931,762 | B1 | | 8/2005 | Dua |
| D517,297 | S | | 3/2006 | Jones et al. |
| 7,022,096 | B1 | | 4/2006 | Alfieri |
| 7,051,460 | B2 | | 5/2006 | Orei et al. |
| 7,056,402 | B2 | | 6/2006 | Koerwien et al. |
| 7,347,011 | B2 | | 3/2008 | Dua et al. |
| 7,441,348 | B1 | | 10/2008 | Dawson |
| D593,715 | S | | 6/2009 | Scheffer et al. |
| 7,543,397 | B2 | | 6/2009 | Kilgore et al. |
| 7,568,298 | B2 | | 8/2009 | Kerns |
| 7,682,219 | B2 | | 3/2010 | Falla |
| 8,490,299 | B2 | | 7/2013 | Dua et al. |
| 8,800,172 | B2 | | 8/2014 | Dua et al. |
| 2002/0078599 | A1 | | 6/2002 | Delgorgue et al. |
| 2002/0148258 | A1 | | 10/2002 | Cole et al. |
| 2003/0126762 | A1 | | 7/2003 | Tseng |
| 2003/0191427 | A1 | | 10/2003 | Jay et al. |
| 2004/0118018 | A1 | * | 6/2004 | Dua ..... 36/45 |
| 2004/0181972 | A1 | | 9/2004 | Csorba |
| 2005/0115284 | A1 | | 6/2005 | Dua |
| 2005/0193592 | A1 | | 9/2005 | Dua et al. |
| 2005/0273988 | A1 | | 12/2005 | Christy |
| 2005/0284000 | A1 | | 12/2005 | Kerns |
| 2006/0059715 | A1 | | 3/2006 | Aveni |
| 2006/0162187 | A1 | | 7/2006 | Byrnes et al. |
| 2007/0022627 | A1 | | 2/2007 | Sokolowski et al. |
| 2007/0180730 | A1 | | 8/2007 | Greene et al. |
| 2008/0017294 | A1 | | 1/2008 | Bailey et al. |
| 2008/0078102 | A1 | | 4/2008 | Kilgore et al. |
| 2008/0110048 | A1 | * | 5/2008 | Dua et al. ..... 36/45 |
| 2008/0189830 | A1 | | 8/2008 | Egglesfield |
| 2008/0313939 | A1 | | 12/2008 | Ardill |
| 2009/0068908 | A1 | | 3/2009 | Hinchcliff |
| 2009/0288451 | A1 | | 11/2009 | Yokoyama |
| 2010/0051132 | A1 | | 3/2010 | Glenn |
| 2010/0154256 | A1 | | 6/2010 | Dua |
| 2010/0170651 | A1 | | 7/2010 | Scherb et al. |
| 2011/0030244 | A1 | | 2/2011 | Motawi et al. |
| 2011/0078921 | A1 | | 4/2011 | Greene et al. |
| 2011/0277218 | A1 | | 11/2011 | Padilla et al. |
| 2011/0308110 | A1 | | 12/2011 | Berns et al. |
| 2012/0233882 | A1 | | 9/2012 | Huffa et al. |
| 2012/0246973 | A1 | | 10/2012 | Dua |
| 2012/0255201 | A1 | | 10/2012 | Little |

FOREIGN PATENT DOCUMENTS

| | | |
|---|---|---|
| DE | 19738433 | 4/1998 |
| DE | 19728848 | 1/1999 |
| EP | 0448714 | 10/1991 |
| EP | 0682960 | 11/1995 |

(56) References Cited

FOREIGN PATENT DOCUMENTS

| | | | |
|---|---|---|---|
| EP | 0728860 | | 8/1996 |
| EP | 0758693 | | 2/1997 |
| EP | 0279950 | A2 | 8/1998 |
| EP | 0898002 | A2 | 2/1999 |
| EP | 1233091 | | 8/2002 |
| EP | 1437057 | A1 | 7/2004 |
| EP | 1563752 | A1 | 8/2005 |
| EP | 1602762 | A1 | 12/2005 |
| EP | 1972706 | A1 | 9/2008 |
| FR | 2171172 | | 9/1973 |
| FR | 2607678 | A1 | 6/1988 |
| GB | 12787 | | 0/1904 |
| GB | 538865 | | 8/1941 |
| GB | 2018837 | A | 10/1979 |
| GB | 1603487 | | 11/1981 |
| JP | H06113905 | | 4/1994 |
| JP | H08109553 | | 4/1996 |
| JP | H11302943 | | 11/1999 |
| JP | 3132794 | U | 6/2007 |
| NL | 7304678 | | 10/1974 |
| WO | 9003744 | | 4/1990 |
| WO | 0032861 | | 6/2000 |
| WO | 0231247 | | 4/2002 |

OTHER PUBLICATIONS

Van der Linden, Ravelry.com, The Scent of Lavender, Oct. 6, 2011.*
Margaritabenitez.com, Chapter 9 Knitted Fabrics and Their Properties, accessed Mar. 4, 2015.*
Miranda, onelittleminuteblog.com, Jan. 7, 2013.*
Doilies Are Stylish, Socks, Oct. 19, 2011, http://doiliesarestylish.blogspot.com/p/socks.html.*
Declaration of Dr. Edward C. Frederick from the US Patent and Trademark Office Inter Partes Review of U.S. Pat. No. 7,347,011 (178 pp).
David J. Spencer, Knitting Technology: A Comprehensive Handbook and Practical Guide (Third ed., Woodhead Publishing Ltd. 2001) (413 pp).
Excerpt of Hannelore Eberle et al., Clothing Technology (Third English ed., Beuth-Verlag GmnH 2002) (book cover and back; pp. 2-3, 83).
International Search Report and Written Opinion in connection with PCT/US2009/056795 mailed on Apr. 20, 2010.
International Search Report and Written Opinion in connection with PCT/US2012/028576 mailed on Oct. 1, 2012.
International Search Report and Written Opinion in connection with PCT/US2012/028559 mailed on Oct. 19, 2012.
International Search Report and Written Opinion in connection with PCT/US2012/028534 mailed on Oct. 17, 2012.
International Preliminary Report on Patentability in connection with PCT/US2012/028534 mailed Sep. 17, 2013.
International Preliminary Report on Patentability in connection with PCT/US2012/028576 mailed Sep. 17, 2013.
Letter from Bruce Huffa dated Dec. 23, 2013 (71 Pages).
International Search Report and Written Opinion mailed Oct. 9, 2014 in International Application No. PCT/US2014/043596.
International Preliminary Report on Patentability from corresponding PCT/US2014/043596, dated Mar. 1, 2016, 8 pages.
Office Action and English translation from corresponding ROC (Taiwan) Pat. Appln. No. 103127823 dated Feb. 1, 2016, 25 pages.

* cited by examiner

ARTICLE OF FOOTWEAR INCORPORATING A KNITTED COMPONENT WITH AN INTEGRAL KNIT ANKLE CUFF

CROSS-REFERENCE TO RELATED APPLICATION

This application is a continuation of U.S. patent application Ser. No. 14/013,446, filed on Aug. 29, 2013, entitled "Article Of Footwear Incorporating A Knitted Component With An Integral Knit Ankle Cuff", the disclosure of which application is hereby incorporated by reference in its entirety.

BACKGROUND

Conventional articles of footwear generally include two primary elements, an upper and a sole structure. The upper is secured to the sole structure and forms a void on the interior of the footwear for comfortably and securely receiving a foot. The sole structure is secured to a lower surface of the upper so as to be positioned between the upper and the ground. In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole is secured to a lower surface of the midsole and forms a ground-engaging portion of the sole structure that is formed from a durable and wear-resistant material. The sole structure may also include a sockliner positioned within the void and proximal a lower surface of the foot to enhance footwear comfort.

The upper generally extends over the instep and toe areas of the foot, along the medial and lateral sides of the foot, and around the heel area of the foot. In some articles of footwear, such as basketball footwear and boots, the upper may extend upward and around the ankle to provide support or protection for the ankle. Access to the void on the interior of the upper is generally provided by an opening in a heel region of the footwear. A lacing system is often incorporated into the upper to adjust the fit of the upper, thereby permitting entry and removal of the foot from the void within the upper. The lacing system also permits the wearer to modify certain dimensions of the upper, particularly girth, to accommodate feet with varying dimensions. In addition, the upper may include a tongue that extends under the lacing system to enhance adjustability of the footwear, and the upper may incorporate a heel counter to limit movement of the heel.

Various materials are conventionally used in manufacturing the upper. The upper of athletic footwear, for example, may be formed from multiple material elements. The materials may be selected based upon various properties, including stretch-resistance, wear-resistance, flexibility, air-permeability, compressibility, and moisture-wicking, for example. With regard to an exterior of the upper, the toe area and the heel area may be formed of leather, synthetic leather, or a rubber material to impart a relatively high degree of wear-resistance. Leather, synthetic leather, and rubber materials may not exhibit the desired degree of flexibility and air-permeability for various other areas of the exterior. Accordingly, the other areas of the exterior may be formed from a synthetic textile, for example. The exterior of the upper may be formed, therefore, from numerous material elements that each impart different properties to the upper. An intermediate or central layer of the upper may be formed from a lightweight polymer foam material that provides cushioning and enhances comfort. Similarly, an interior of the upper may be formed of a comfortable and moisture-wicking textile that removes perspiration from the area immediately surrounding the foot. The various material elements and other components may be joined with an adhesive or stitching. Accordingly, the conventional upper is formed from various material elements that each impart different properties to various areas of the footwear.

SUMMARY

Various configurations of an article of footwear may have an upper and a sole structure secured to the upper. A knitted component including an upper and an integral knit ankle cuff is incorporated into the article of footwear. The upper and the integral knit ankle cuff are formed as a one-piece knit element. The knit element defines a portion of an exterior surface of the upper and an opposite interior surface of the upper, with the interior surface defining a void for receiving a foot. The integral knit ankle cuff is formed of unitary knit construction with the upper as a one-piece knit element and extends above a throat area of the upper. The knit component incorporates features to assist with providing entry for a foot of a wear, providing comfort to a wearer, and to assist with orientation of the upper of the article of footwear when being worn.

In one aspect, the invention provides an article of footwear having an upper and a sole structure secured to the upper, the upper including a knitted component that is formed of unitary knit construction, the knitted component including: a foot region forming a substantial majority of the upper, the foot region extending through a forefoot region, a midfoot region, and a heel region of the article of footwear, the foot region including an instep area that extends between a medial side and a lateral side of the upper; an ankle region forming a portion of the upper that extends above the foot region, the ankle region including an ankle cuff that defines a throat opening to a void within the upper for receiving a foot; wherein the ankle cuff is formed of unitary knit construction with at least the instep area of the foot region and a portion of foot region disposed on the medial side and lateral side in the heel region; and wherein the ankle cuff further comprises at least one malleolus zone disposed on at least one of the medial side and the lateral side of the upper, the at least one malleolus zone including a plurality of indentations in an exterior surface of the ankle cuff.

In another aspect, the invention provides an article of footwear having an upper and a sole structure secured to the upper, the upper including a knitted component that is formed of unitary knit construction, the knitted component including: a foot region forming a substantial majority of the upper, the foot region extending through a forefoot region, a midfoot region, and a heel region of the article of footwear, the foot region including an instep area that extends between a medial side and a lateral side of the upper; an ankle region forming a portion of the upper that extends above the foot region, the ankle region including an ankle cuff that defines a throat opening to a void within the upper for receiving a foot; the instep area further including a stretch padding zone surrounded by and formed of unitary knit construction with the instep area, the stretch padding zone being disposed between the medial side and the lateral side of the upper along a top portion of the article of footwear; the stretch padding zone being configured to stretch in a lateral direction across the article of footwear between an unstretched condition and a stretched condition; and wherein the stretch padding zone has a first thickness in the unstretched condition and a second thickness in the stretched condition, the first thickness being larger than the second thickness.

In another aspect, the invention provides an article of footwear having an upper and a sole structure secured to the upper, the upper including a knitted component that is formed of unitary knit construction, the knitted component including: a foot region forming a substantial majority of the upper, the foot region extending through a forefoot region, a midfoot region, and a heel region of the article of footwear, the foot region including an instep area that extends between a medial side and a lateral side of the upper; an ankle region forming a portion of the upper that extends above the foot region, the ankle region including an ankle cuff that defines a throat opening to a void within the upper for receiving a foot; and wherein the knitted component further comprises a tied-lace receiving aperture formed into at least one of the instep area and the ankle cuff, the tied-lace receiving aperture being configured to receive loose ends of a tied lace within an interior of the upper.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
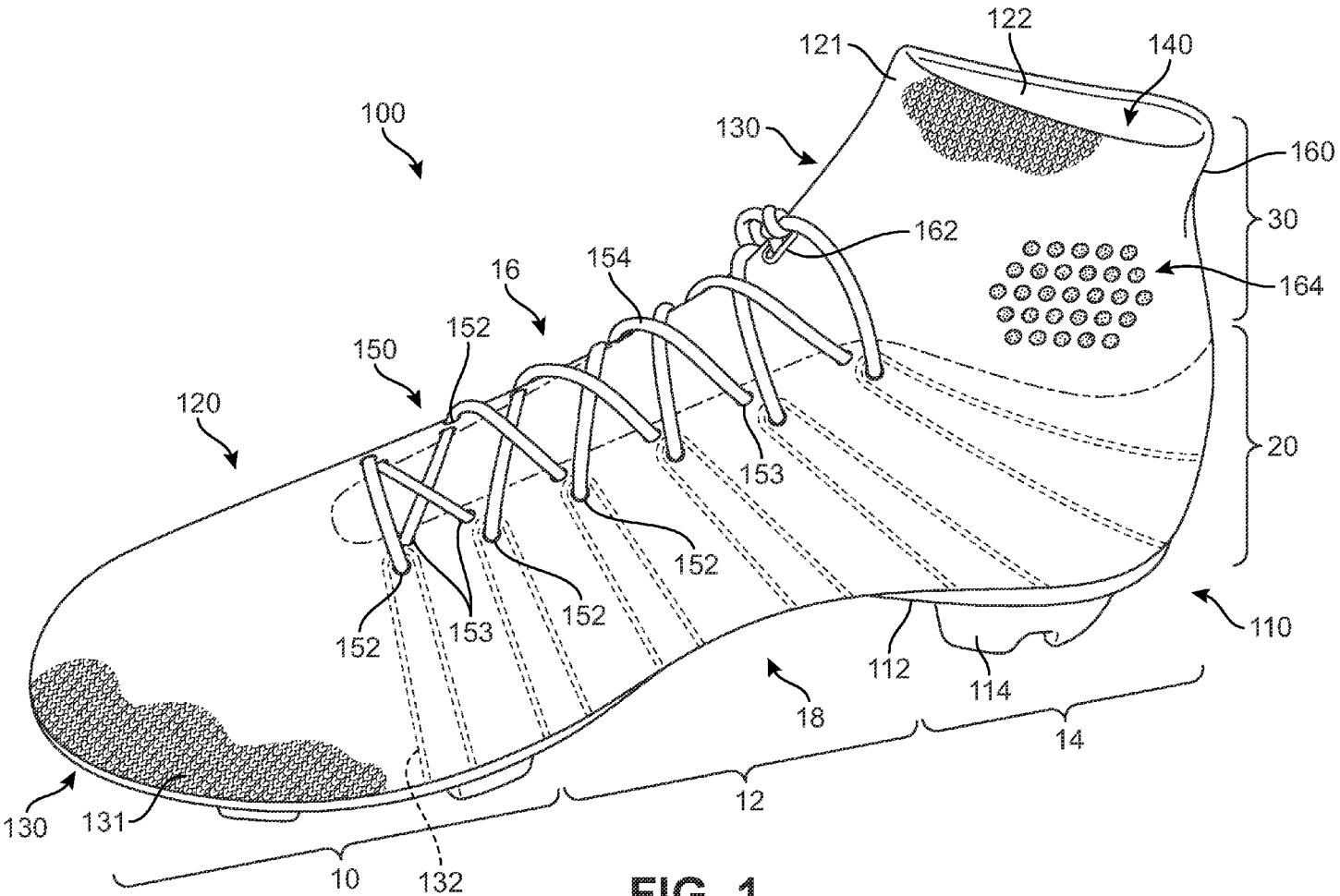
FIG. 1 is an isometric view of an exemplary embodiment of an article of footwear.

The following discussion and accompanying figures disclose a variety of concepts relating to knitted components and the manufacture of knitted components. Although the knitted components may be used in a variety of products, an article of footwear that incorporates one of the knitted components is disclosed below as an example. FIGS. 1 through 20 illustrate an exemplary embodiment of an article of footwear incorporating a knitted component including an upper and an integral knit ankle cuff. The individual features of the knitted component as described herein may be used in combination or may be provided separately in different configurations for articles of footwear. In addition, any of the features may be optional and may not be included in any one particular embodiment of a knitted component.

FIGS. 1 through 4 illustrate an exemplary embodiment of an article of footwear 100, also referred to simply as article 100. In some embodiments, article of footwear 100 may include a sole structure 110 and an upper 120. Although article 100 is illustrated as having a general configuration suitable for soccer, concepts associated with article 100 may also be applied to a variety of other athletic footwear types, including baseball shoes, basketball shoes, cycling shoes, football shoes, tennis shoes, running shoes, training shoes, walking shoes, and hiking boots, for example. The concepts may also be applied to footwear types that are generally considered to be non-athletic, including dress shoes, loafers, sandals, and work boots. Accordingly, the concepts disclosed with respect to article 100 may be applied to a wide variety of footwear types.

Figure 2:
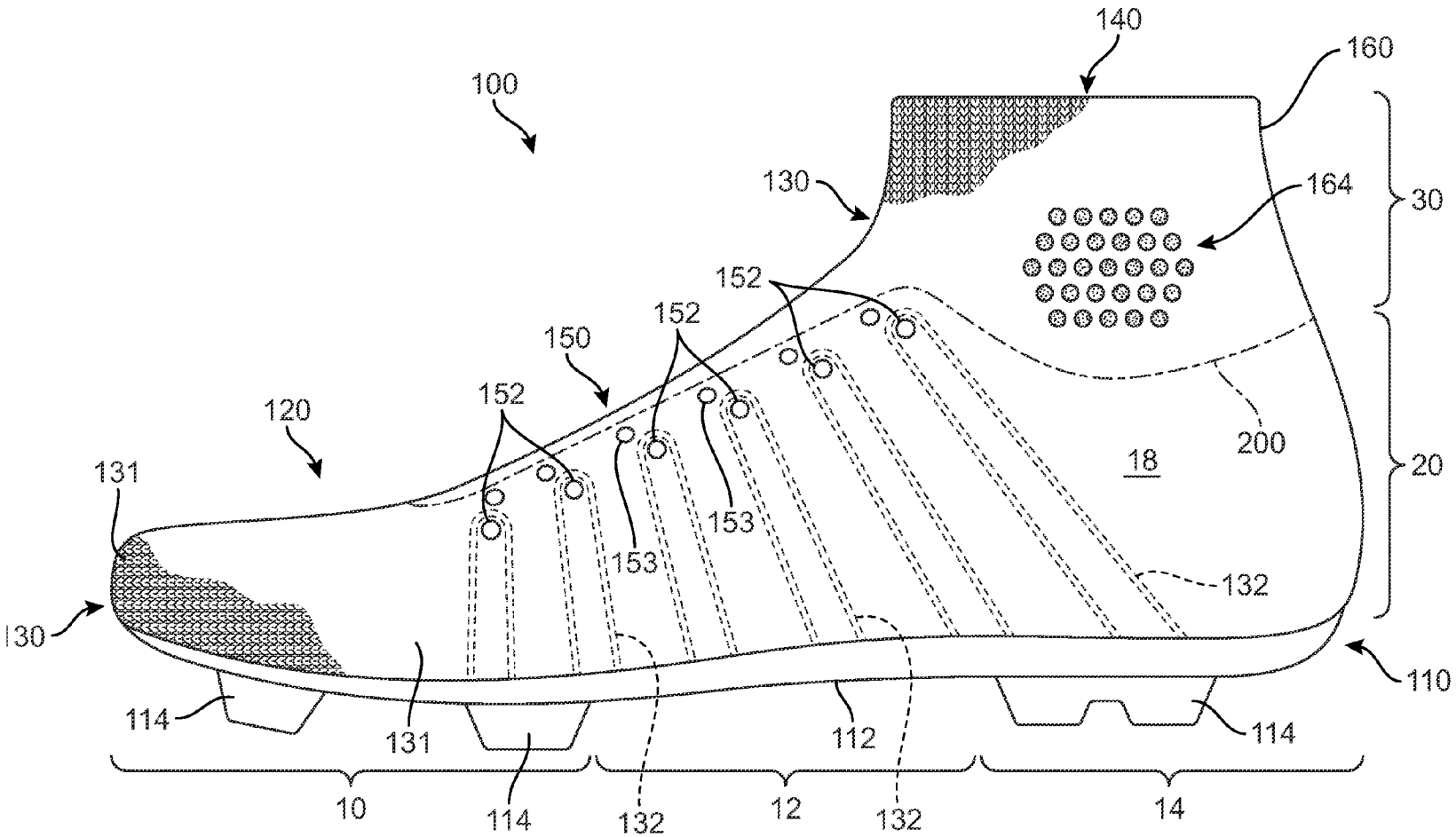
FIG. 2 is a medial side view of an exemplary embodiment of an article of footwear.
Figure 3:
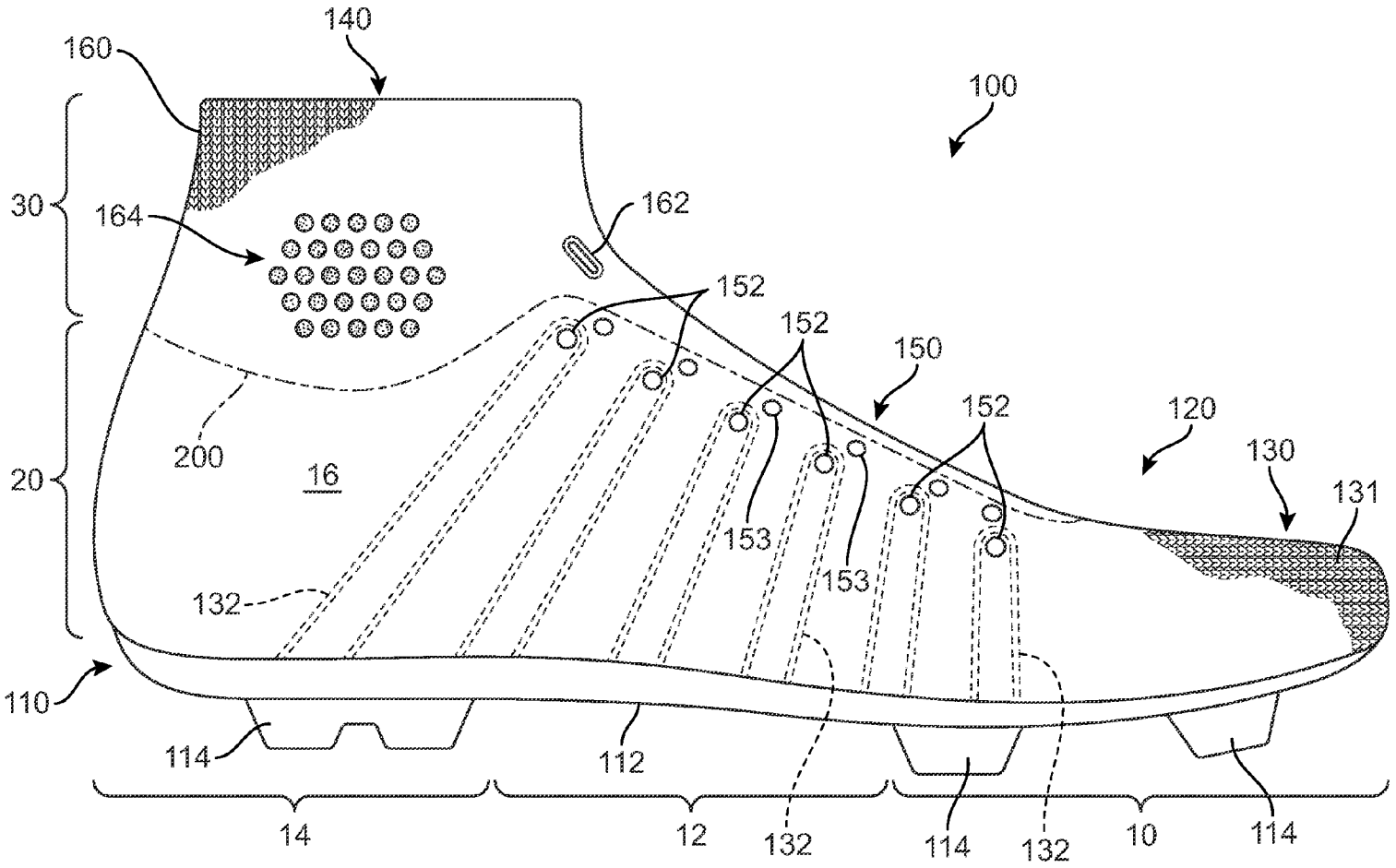
FIG. 3 is a lateral side view of an exemplary embodiment of an article of footwear.

For reference purposes, article 100 may be divided into three general regions: a forefoot region 10, a midfoot region 12, and a heel region 14, as shown in FIGS. 1, 2, and 3. Forefoot region 10 generally includes portions of article 100 corresponding with the toes and the joints connecting the metatarsals with the phalanges. Midfoot region 12 generally includes portions of article 100 corresponding with an arch area of the foot. Heel region 14 generally corresponds with rear portions of the foot, including the calcaneus bone. Article 100 also includes a lateral side 16 and a medial side 18, which extend through each of forefoot region 10, midfoot region 12, and heel region 14 and correspond with opposite sides of article 100. More particularly, lateral side 16 corresponds with an outside area of the foot (i.e., the surface that faces away from the other foot), and medial side 18 corresponds with an inside area of the foot (i.e., the surface that faces toward the other foot). Forefoot region 10, midfoot region 12, and heel region 14 and lateral side 16, medial side 18 are not intended to demarcate precise areas of article 100. Rather, forefoot region 10, midfoot region 12, and heel region 14 and lateral side 16, medial side 18 are intended to represent general areas of article 100 to aid in the following discussion. In addition to article 100, forefoot region 10, midfoot region 12, and heel region 14 and lateral side 16, medial side 18 may also be applied to sole structure 110, upper 120, and individual elements thereof.

In an exemplary embodiment, sole structure 110 is secured to upper 120 and extends between the foot and the ground when article 100 is worn. In some embodiments, sole structure 110 may include one or more components, including a midsole, an outsole, and/or a sockliner or insole. In an exemplary embodiment, sole structure 110 may include an outsole 112 that is secured to a lower surface of upper 120 and/or a base portion configured for securing sole structure 110 to upper 120. In one embodiment, outsole 112 may be formed from a wear-resistant rubber material that is textured to impart traction. In this embodiment, outsole 112 includes a plurality of cleat members 114 that are configured to provide traction with a ground surface. Although this configuration for sole structure 110 provides an example of a sole structure that may be used in connection with upper 120, a variety of other conventional or nonconventional configurations for sole structure 110 may also be used. Accordingly, in other embodiments, the features of sole structure 110 or any sole structure used with upper 120 may vary.

For example, in other embodiments, sole structure 110 may include a midsole and/or a sockliner. A midsole may be secured to a lower surface of an upper and in some cases may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In other cases, a midsole may incorporate plates, moderators, fluid-filled chambers, lasting elements, or motion control members that further attenuate forces, enhance stability, or influence the motions of the foot. In still other cases, the midsole may be primarily formed from a fluid-filled chamber that is located within an upper and is positioned to extend under a lower surface of the foot to enhance the comfort of an article.

In some embodiments, upper 120 defines a void within article 100 for receiving and securing a foot relative to sole structure 110. The void is shaped to accommodate the foot and extends along a lateral side of the foot, along a medial side of the foot, over the foot, around the heel, and under the foot. Upper 120 includes an exterior surface 121 and an opposite interior surface 122. Whereas exterior surface 121 faces outward and away from article 100, interior surface 122 faces inward and defines a majority or a relatively large portion of the void within article 100 for receiving the foot. Moreover, interior surface 121 may lay against the foot or a sock covering the foot. Access to the void is provided by a throat opening 140 located in at least heel region 14. More particularly, the foot may be inserted into upper 120 through throat opening 140, and the foot may be withdrawn from upper 120 through throat opening 140. In some embodiments, an instep area 150 extends from ankle opening 140 in heel region 14 over an area corresponding to an instep of the foot to an area adjacent to forefoot region 10.

A lace 154 extends through various lace apertures in upper 120 and permits the wearer to modify dimensions of upper 120 to accommodate proportions of the foot. More particularly, lace 154 permits the wearer to tighten upper 120 around the foot, and lace 154 permits the wearer to loosen upper 120 to facilitate entry and removal of the foot from the void (i.e., through throat opening 140). In addition, a portion of upper 120 in instep area 150 extends under lace 154 to enhance the comfort of article 100. In further configurations, upper 120 may include additional elements, such as (a) a heel counter in heel region 14 that enhances stability, (b) a toe guard in forefoot region 10 that is formed of a wear-resistant material, and (c) logos, trademarks, and placards with care instructions and material information.

In some embodiments, lace 154 may extend through pairs of lace apertures that are disposed along either side of instep area 150. In an exemplary embodiment, pairs of lace apertures may include a plurality of outer lace apertures 152 and a plurality of inner lace apertures 153. Plurality of outer lace apertures 152 may be disposed at a first location along instep area 150. Plurality of inner lace apertures 153 may be disposed at a second location along instep area 150 that is located more inward towards the middle of upper 120 than outer lace apertures 152 on each of lateral side 16 and medial side 18. In addition, the location of outer lace apertures 152 and inner lace apertures 153 may be offset along instep area 150 in the longitudinal direction. With this configuration, lace 154 may pass through an inner lace aperture 153, extend under knitted component 130 along interior surface 122, and exit knitted component 130 through an outer lace aperture 152 to continue along exterior surface 121. Lace 154 may continue passing through plurality of apertures 152, 153 in this manner throughout instep area 150.

Figure 4:
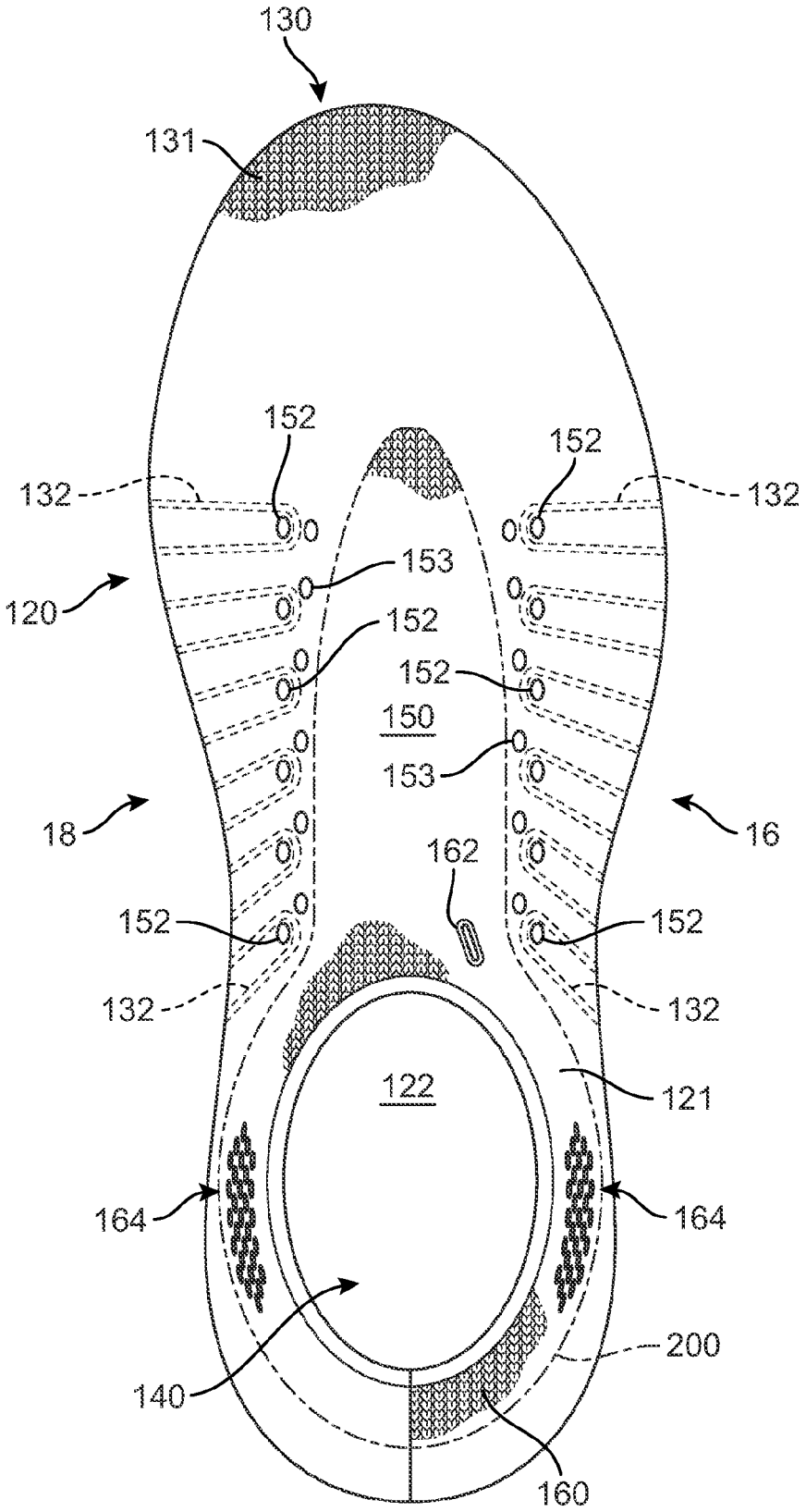
FIG. 4 is a top plan view of an exemplary embodiment of an article of footwear.

Many conventional footwear uppers are formed from multiple material elements (e.g., textiles, polymer foam, polymer sheets, leather, synthetic leather) that are joined through stitching or bonding, for example. In contrast, in some embodiments, a majority of upper 120 is formed from a knitted component 130, which will be discussed in more detail below. Knitted component 130 may, for example, be manufactured through a flat knitting process and extends through each of each of forefoot region 10, midfoot region 12, and heel region 14, along both lateral side 16 and medial side 18, over forefoot region 10, and around heel region 14. In an exemplary embodiment, knitted component 130 forms substantially all of upper 120, including exterior surface 121 and a majority or a relatively large portion of interior surface 122, thereby defining a portion of the void within upper 120. In some embodiments, knitted component 130 may also extend under the foot. In other embodiments, however, a strobel sock or thin sole-shaped piece of material is secured to knitted component 130 to form a base portion of upper 120 that extends under the foot for attachment with sole structure 110. In addition, a seam extends vertically through heel region 14, as depicted in FIG. 4, to join edges of knitted component 130.

Additionally, while knitted component 130 forms portions of both of exterior surface 121 and interior surface 122, in some embodiments, a polymer layer or a skin layer may be bonded with areas of knitted component 130, as disclosed in U.S. Ser. No. 13/079,653 to Dua, entitled "Article Of Footwear Having A Knit Upper With A Polymer Layer", filed on Apr. 4, 2011 and published on Oct. 4, 2012 as U.S. Patent Application Publication 2012/0246973, the disclosure of which application is entirely incorporated herein by reference.

In some embodiments, article 100 may include an integral knit ankle cuff 160 for covering at least a portion of an ankle of the wearer. In addition to covering the foot, therefore, upper 120 extends upward and covers a portion of the ankle. For reference purposes, upper 120 may be divided into two general regions: a foot region 20 and an ankle region 30, as shown in FIGS. 1, 2, and 3. Foot region 20 extends through each of forefoot region 10, midfoot region 12, and heel region 14 and generally encompasses portions of upper 120 corresponding with the foot. In many configurations of article 100, foot region 20 corresponds with portions of upper 120 that are intended to be below the lateral malleolus and the medial malleolus (i.e., the bony prominences on each side of the ankle) of the wearer. Ankle region 30 is primarily located in heel region 14 and generally encompasses portions of upper 120 corresponding with the ankle. In many configurations of article 100, ankle region 30 corresponds with portions of upper 120 that are intended to cover and extend above the lateral malleolus and the medial malleolus.

In an exemplary embodiment, a boundary region 200 separates foot region 20 from ankle region 30. In this embodiment, boundary region 200 defines the portion of upper 120 where ankle cuff 160 begins to extend upwards from foot region 20. In some embodiments, boundary region 200 may demarcate the portion of knitted component 130 where the properties of the knit structure associated with ankle cuff 160, for example, a stich type, a yarn type, or characteristics associated with different stitch types or yarn types, including aesthetics, stretch, thickness, air permeability, and abrasion-resistance, may be varied from the remaining portion of upper 120. It should be understood that in some cases, boundary region 200 may be visibly indicated on upper 120 by virtue of differences in the knit structure or other indicia. In other cases, however, boundary region 200 may not be visible on upper 120 and the portion of upper 120 associated with foot region 20 and ankle region 30 may have a continuous appearance.

Ankle cuff 160 is located in ankle region 30 and forms an ankle part of knitted component 130. A remainder of knitted component 130, which is located in foot region 20, forms a foot part of knitted component 130. Whereas the foot part of knitted component 130 covers the foot of the wearer, the ankle part of knitted component 130, which includes ankle cuff 160, covers the ankle of the wearer when article 100 is worn. Moreover, ankle cuff 160 and the ankle part of knitted component 130 may be formed of unitary knit construction with the foot part of knitted component 130.

Although a seam may be present in ankle cuff 160, the ankle part of knitted component 130 has a continuous structure for extending entirely around the ankle of the wearer. Referring to the top plan view of FIG. 4, ankle cuff 160 forms a circular, oval, or otherwise continuous and rounded throat opening 140 that provides access to the void within upper 120. Throat opening 140 may have relatively large dimensions that allow the foot to pass through and into the void. In some embodiments, throat opening 140 may stretch to accommodate the foot. Moreover, ankle cuff 160 may have dimensions that are smaller than an average ankle diameter. Therefore, ankle cuff 160 may remain somewhat stretched and lay firmly against the ankle once the foot is located within the void. Accordingly, ankle cuff 160 and other portions of knitted component 130 in ankle region 30 may be formed to have stretch properties.

In some embodiments, knitted component 130 may include one or more features to assist with providing entry for a foot of a wearer, providing comfort to a wearer, and to assist with orientation of upper 120 of article 100 when being worn. In an exemplary embodiment, ankle cuff 160 may include features that are configured to correspond with the lateral and medial malleolus bones of a wearer. In one embodiment, ankle cuff 160 includes malleolus zone 164 disposed on each of lateral side 16 and medial side 18 of upper 120. As described in more detail below, malleolus zone 164 provides a knit structure on ankle cuff 160 that allows for increased stretch and comfort to a wearer of article 100. Additionally, malleolus zone 164 may assist with maintaining an orientation of upper 120 on a foot of a wearer by covering and closely fitting to the malleolus bones of the wearer.

In some embodiments, knitted component 130 may further include a tied-lace receiving aperture 162. In an exemplary embodiment, tied-lace receiving aperture 162 may be disposed on a portion of instep area 150 and/or ankle cuff 160 proximate to or adjacent to boundary region 200 between foot region 20 and ankle region 30. With this configuration, tied-lace receiving aperture may be located approximately where lacing apertures 152, 153 end at a top portion of a lacing region of upper 120. In one embodiment, tied-lace receiving aperture 162 may be configured to receive a tied and knotted lace, for example, lace 154.

Knitted component 130 extends throughout upper 120 and forms a majority of interior surface 122, thereby defining a portion of the void within upper 120. Although seams may be present in knitted component 130, a majority of knitted component 130 has a substantially seamless configuration. Moreover, knitted component 130 may be formed of unitary knit construction. As utilized herein, a knitted component (e.g., knitted component 130) is defined as being formed of "unitary knit construction" when formed as a one-piece element through a knitting process. That is, the knitting process substantially forms the various features and structures of knitted component 130 without the need for significant additional manufacturing steps or processes. A unitary knit construction may be used to form a knitted component having structures or elements that include one or more courses of yarn or other knit material that are joined such that the structures or elements include at least one course in common (i.e., sharing a common yarn) and/or include courses that are substantially continuous between each of the structures or elements. With this arrangement, a one-piece element of unitary knit construction is provided.

Although portions of knitted component 130 may be joined to each other (e.g., edges of knitted component 130 being joined together) following the knitting process, knitted component 130 remains formed of unitary knit construction because it is formed as a one-piece knit element. Moreover, knitted component 130 remains formed of unitary knit construction when other elements (e.g., a lace, logos, trademarks, placards with care instructions and material information, structural elements) are added following the knitting process.

Examples of various configurations of knitted components that may be utilized for knitted component 130 are disclosed in U.S. Pat. No. 6,931,762 to Dua; U.S. Pat. No. 7,347,011 to Dua, et al.; U.S. Patent Application Publication 2008/0110048 to Dua, et al.; U.S. Patent Application Publication 2010/0154256 to Dua; and U.S. Patent Application Publication 2012/0233882 to Huffa, et al., the disclosures of each of which are entirely incorporated herein by reference.

The primary elements of knitted component 130 are a knit element 131 and an inlaid strand 132. Knit element 131 is formed from at least one yarn that is manipulated (e.g., with a knitting machine) to form a plurality of intermeshed loops that define a variety of courses and wales. That is, knit element 131 has the structure of a knit textile. Inlaid strand 132 extends through knit element 131 and passes between the various loops within knit element 131. Although inlaid strand 132 generally extends along courses within knit element 131, inlaid strand 132 may also extend along wales within knit element 131. Advantages of inlaid strand 132 include providing support, stability, and structure. For example, inlaid strand 132 assists with securing upper 120 around the foot, limits deformation in areas of upper 120 (e.g., imparts stretch-resistance), and operates in connection with lace 154 to enhance the fit of article 100. U.S. Patent Application Publication 2012/0233882 to Huffa, et al., which was referenced above and incorporated herein, provides discussion of the manner in which knitted component 130 may be formed, including the process of inlaying or otherwise locating inlaid strand 132 within knit element 131.

In some embodiments, inlaid strand 132 may extend through knit element 131 in an upwards direction from sole structure 110 towards instep area 150. In an exemplary embodiment, inlaid strand 132 may extend between each inner lace aperture 153 and each outer lace aperture 152 and extend back in a downwards direction from instep area 150 towards sole structure 110. For example, inlaid strand 132 may form a loop around outer lace aperture 152, while inner lace aperture 153 is located outside of the loop. With this configuration, inlaid strand 132 may reinforce outer lace aperture 152.

In addition, when article 100 is provided with lace 154, inlaid strand 132 extending around outer lace aperture 152 may assist with providing support and/or stability to a foot of a wearer. In some embodiments, inlaid strand 132 may be tensioned when lace 154 is tightened, and inlaid strand 132 resists stretch in upper 120. Moreover, inlaid strand 132 assists with securing upper 120 around the foot and operates in connection with lace 154 to enhance the fit of article 100. For example, in embodiments where lace 154 passes into knitted component 130 through inner lace aperture 153 and exits knitted component 130 through outer lace aperture 152, lace 154 is disposed through the loop formed by inlaid strand 132 and allows adjustment of the fit of upper 120 by pulling lace 154 tight. In one embodiment, inlaid strand 132 may extend around outer lace aperture 152 while remaining within knit element 131. That is, inlaid strand 132 may extend through knitted component 130 within one or more courses and/or wales of knit element 131. In other embodiments, however, inlaid strand 132 may exit knit element 131 at one or more portions so as to be exposed on exterior surface 121 and/or interior surface 122.

In an exemplary embodiment, instep area 150 extending between medial side 18 and lateral side 16 may be formed of unitary knit construction with upper 120 and ankle cuff 160. As shown in FIG. 4, the portion of knitted component 130 forming instep area 150 may be substantially continuous with the remaining portion of knitted component forming upper 120 and ankle cuff 160. In this embodiment, instep area 150 is joined through knitting to upper 120 along each of a lateral side and a medial side of instep area 150 such that instep area 150 and upper 120 include at least one course in common and/or include courses that are substantially continuous. In addition, instep area 150 is joined through knitting to ankle cuff 160 forward of throat opening 140 such that instep area 150 and ankle cuff 160 include at least one course in common and/or include courses that are substantially continuous.

Figure 5:
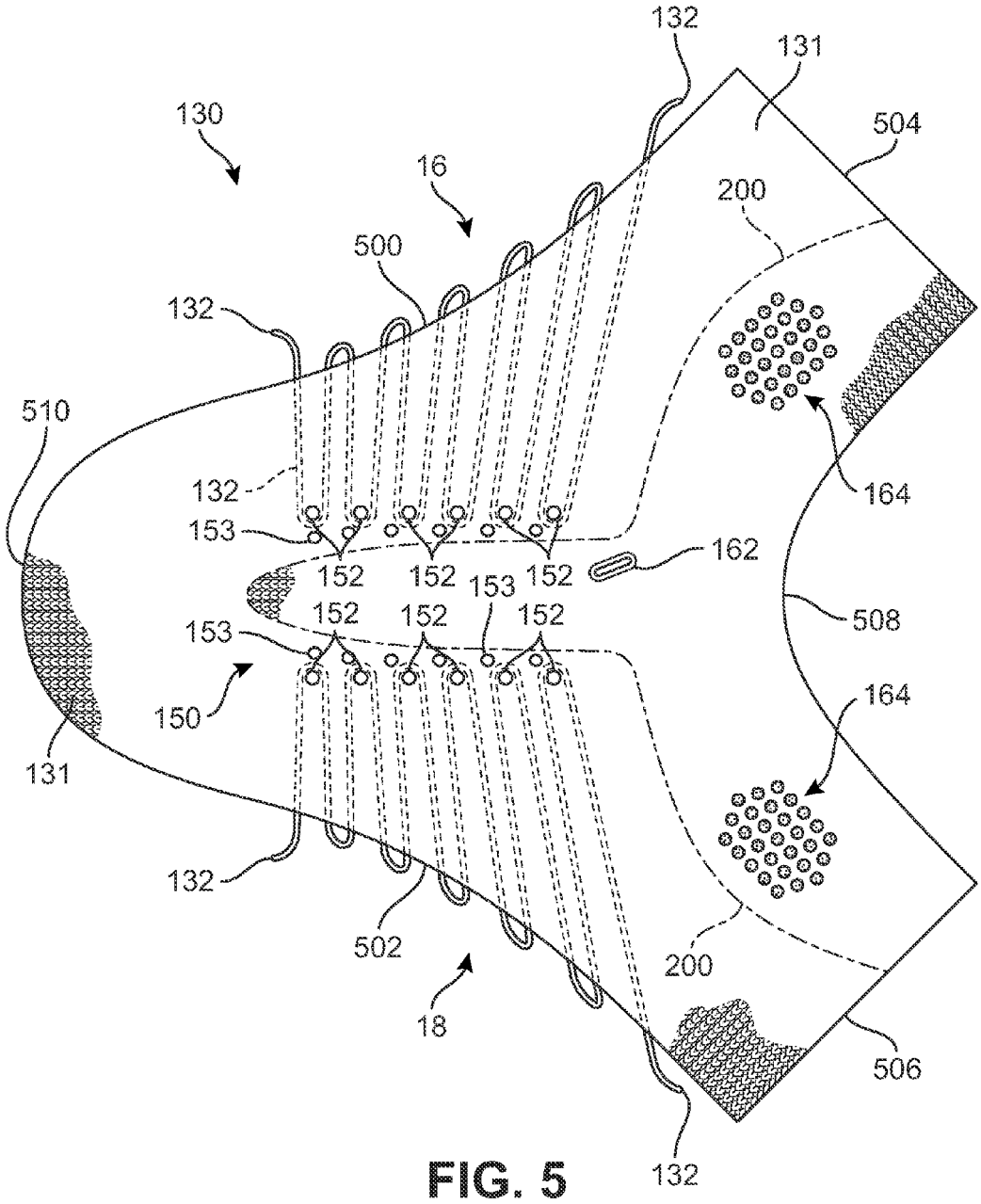
FIG. 5 is a top plan view of an exemplary embodiment of a knitted component incorporated into an upper of an article of footwear.

Referring now to FIG. 5, an exemplary embodiment of knitted component 130 is shown in a planar or flat configuration. In this embodiment, knitted component 130 has a generally Y-shaped configuration that is outlined by an outer perimeter. In this embodiment, the outer perimeter includes a front perimeter edge 510, a lateral perimeter edge 500, and a medial perimeter edge 502 disposed opposite lateral perimeter edge 500. The outer perimeter edge of knitted component 130 also includes a pair of heel edges, including a lateral heel edge 504 and a medial heel edge 506. In an exemplary embodiment, knitted component 130 may further include an inner perimeter that will be associated with and define throat opening 140, described above. In this embodiment, the inner perimeter of knitted component 130 includes inner perimeter edge 508. When incorporated into an article of footwear, including footwear 100, front perimeter edge 510, lateral perimeter edge 500, medial perimeter edge 502, and at least a portion of lateral heel edge 504 and medial heel edge 506 lays against an upper surface of sole structure 110 and may be joined to a strobel sock or sockliner. In addition, lateral heel edge 504 and medial heel edge 506 are joined to each other and extend vertically in heel region 14 of article 100. In some embodiments of an article of footwear, a material element may cover a seam between lateral heel edge 504 and medial heel edge 506 to reinforce the seam and enhance the aesthetic appeal of the footwear.

Knitted component 130 may include instep area 150 that is formed of unitary knit construction with the remaining portion of upper 120 and ankle cuff 160, as described above. In some embodiments, instep area 150 includes plurality of lace apertures 152, 153 disposed in knitted component 130. As described above, lace apertures 152, 153 may extend through knitted component 130 and are configured to receive a lace, including lace 154. In an exemplary embodiment, lace apertures 152, 153 are formed directly into knitted component 130 by knitting. In other embodiments, however, lace apertures 152, 153 may include additional reinforcing elements added to knitted component 130. In some embodiments, instep area 150 may further include tied-lace receiving aperture 162. As described above, tied-lace receiving aperture 162 may be disposed on a portion of instep area 150 and/or ankle cuff 160 proximate to or adjacent to boundary region 200. In an exemplary embodiment, tied-lace receiving aperture 162 may be formed in a similar manner as lace apertures 152, 153. In one embodiment, tied-lace receiving aperture 162 may be formed directed into knitted component 130 using a button-hole stitch or other suitable type of stitch. In other embodiments, tied-lace receiving aperture 162 is optional and may be omitted.

As shown in FIG. 5, each of lateral side 16 and medial side 18 may be associated with a single inlaid strand 132 that alternately passes through knit element 131 and extends outside of knit element 131 at portions of knitted component 130. In this embodiment, inlaid strand 132 exits knit element 131 at various portions of knitted component 130 along each of lateral perimeter edge 500 and medial perimeter edge 502 before extending back into knit element 131. With this arrangement, a single inlaid strand 132 may be used for each of lateral side 16 and medial side 18 of upper 120. In other embodiments, however, additional inlaid strands may be provided at various portions of knitted component 130.

In various embodiments, a knitted component may incorporate various types of yarn that impart different properties to separate areas of the upper. For example, one area of knitted component 130 may be formed from a first type of yarn that imparts a first set of properties, and another area of first knitted component 130 may be formed from a second type of yarn that imparts a second set of properties. In this configuration, properties may vary throughout upper 120 by selecting specific yarns for different areas of knitted component 130.

The properties that a particular type of yarn will impart to an area of a knitted component partially depend upon the materials that form the various filaments and fibers within the yarn. Cotton, for example, provides a soft hand, natural aesthetics, and biodegradability. Elastane and stretch polyester each provide substantial stretch and recovery, with stretch polyester also providing recyclability. Rayon provides high luster and moisture absorption. Wool also provides high moisture absorption, in addition to insulating properties and biodegradability. Nylon is a durable and abrasion-resistant material with relatively high strength. Polyester is a hydrophobic material that also provides relatively high durability.

In addition to materials, other aspects of the yarns selected for a knitted component may affect the properties of the upper. For example, a yarn forming knitted component 130 may be a monofilament yarn or a multifilament yarn. The yarn may also include separate filaments that are each formed of different materials. In addition, the yarn may include filaments that are each formed of two or more different materials, such as a bi-component yarn with filaments having a sheath-core configuration or two halves formed of different materials. Different degrees of twist and crimping, as well as different deniers, may also affect the properties of upper 120. Accordingly, both the materials forming the yarn and other aspects of the yarn may be selected to impart a variety of properties to separate areas of upper 120.

In some embodiments, integral knit ankle cuff 160 may extend from instep area 150 of knitted component 130 rearwards to inner perimeter edge 508 and may further extend across to lateral heel edge 504 and medial heel edge 506. In an exemplary embodiment, ankle cuff 160 is formed of unitary knit construction with upper 120 at a rearward portion of instep area 150 of knitted component 130 as well as on each of lateral side 16 and medial side 18 of upper 120 along boundary region 200. That is, ankle cuff 160 is joined through knitting to upper 120 at the rearward portion of instep area 150 such that ankle cuff 160 and instep area 150 of upper 120 include at least one course in common and/or include courses that are substantially continuous between ankle cuff 160 and upper 120. Similarly, ankle cuff 160 is joined through knitting approximately along boundary region 200 extending around upper 120, including along each side of upper 120 at lateral heel edge 504 and medial heel edge 506. It should be noted that although a dashed line is utilized to separate and define where ankle cuff 160 begins on knitted component 130, the dashed line may be for reference not visible in some configurations of knitted component 130.

In some embodiments, ankle cuff 160 forms a circular or tubular structure in upper 120 that corresponds to throat opening 140 of article 100. When article 100 is worn, ankle cuff 160 extends around or encircles an ankle of the wearer and may lay against the ankle. In some embodiments, ankle cuff 160 may exhibit a greater ability to stretch than the remaining portion of upper 120. An advantage of imparting a relatively small stretch-resistance (i.e., permitting stretch) to ankle cuff 160 is that this area of knitted component 130 will elongate or otherwise stretch as the foot is inserted into upper 120 and withdrawn from upper 120 through throat opening 140 formed by ankle cuff 160. Additionally, ankle cuff 160 may remain in a partially stretched state and lay against the ankle when article 100 is worn, thereby preventing dirt, pebbles, and other debris from entering article 100 through throat opening 140.

In an exemplary embodiment, ankle cuff 160 may include malleolus zone 164 disposed on each of lateral side 16 and medial side 18. As described in more detail with reference to FIGS. 10 through 17, malleolus zone 164 provides a knit structure on ankle cuff 160 that allows for increased stretch and comfort to a wearer of article 100. Additionally, malleolus zone 164 may assist with maintaining an orientation of upper 120 on a foot of a wearer by covering and closely fitting to the malleolus bones of the wearer.

Figure 6:
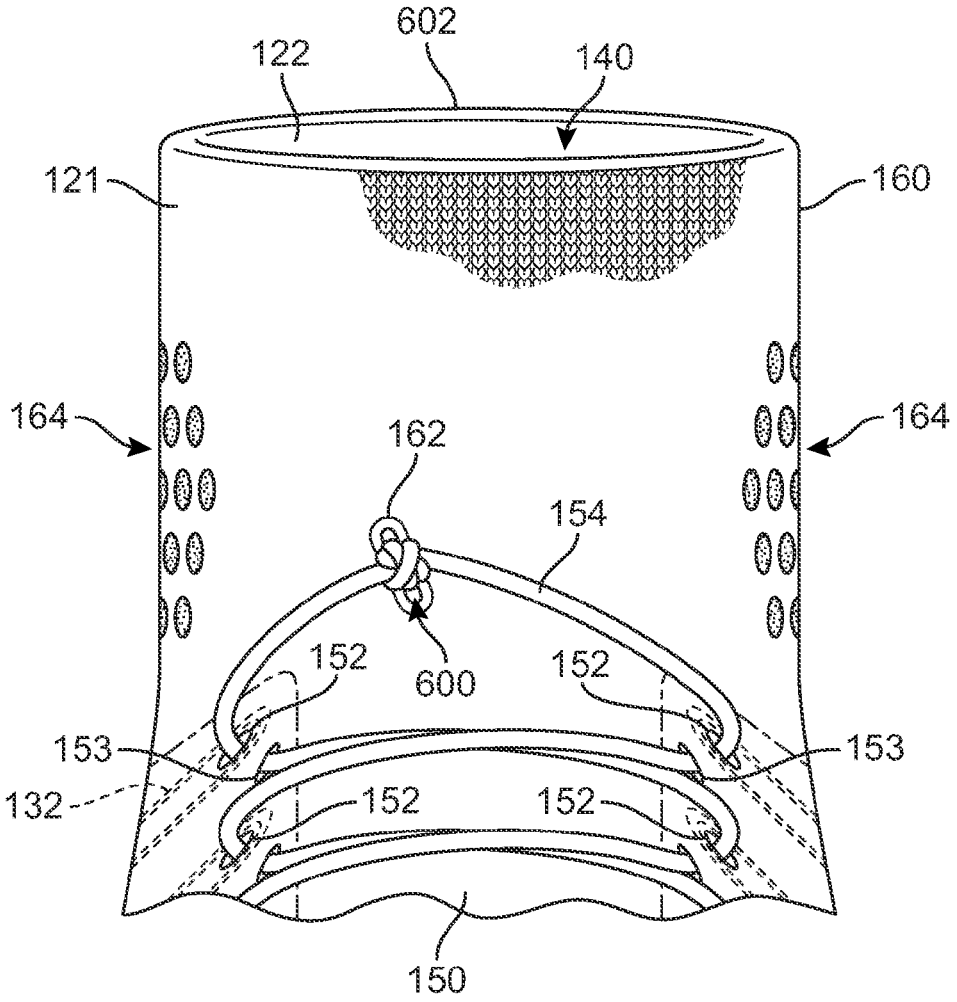
FIG. 6 is an enlarged front view of an exemplary embodiment of a knit cuff of an article of footwear.

Referring now to FIGS. 6 through 9, an exemplary embodiment of tied-lace receiving aperture 162 is illustrated on ankle cuff 160. In some embodiments, tied-lace receiving aperture 162 may be located in instep area 150 or ankle cuff 160. The location of tied-lace receiving aperture 162 may be chosen to correspond to the location of the top-most set of lace apertures 152, 153 or slightly above the top-most set of lace apertures 152, 153. In this embodiment, the top-most set of lace apertures 152, 153 are disposed on each of lateral side 16 and medial side 18 closest to a top edge 602 of throat opening 140. With this configuration, once lace 154 extends through the top-most set of lace apertures 152, 153, the tied and knotted lace may be tucked through a hole 600 defined by tied-lace receiving aperture 162. As shown in FIG. 6, hole 600 extends through upper 120 from exterior surface 121 to interior surface 122.

Figure 7:
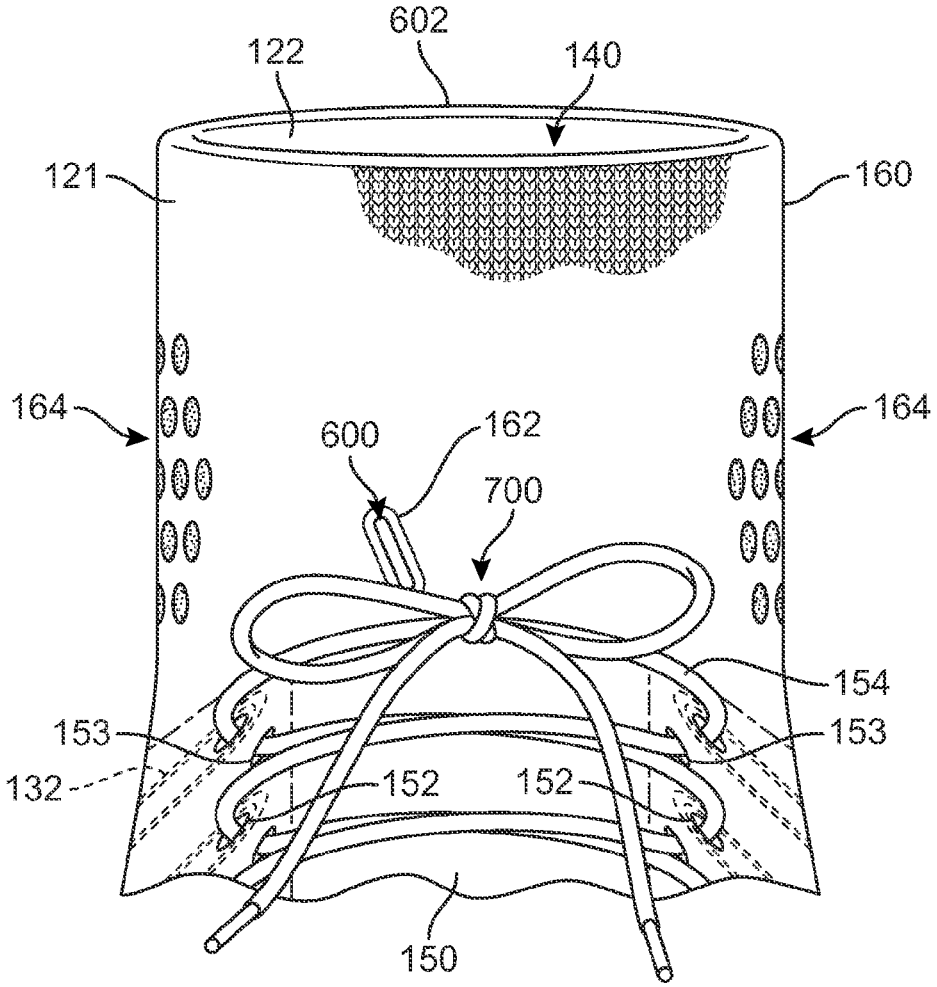
FIG. 7 is an enlarged front view of an exemplary embodiment of a knit cuff including an aperture for receiving a tied lace.

FIGS. 7 though 9 illustrate an exemplary process of using tied-lace receiving aperture 162 to tuck loose ends of a tied and knotted lace into hole 600 so that the loose ends of the tied and knotted lace is disposed within the interior of upper 120. As shown in FIG. 7, article 100 may be optionally fastened to a desired amount of tightness around a foot within the interior of upper 120 by using lace 154 disposed through lace apertures 152, 153. Once lace 154 is at the desired amount of tightness, lace 154 may then be tied and knotted into a bow 700. It should be understood that bow 700 is illustrated for purposes of example, however, in other embodiments, different mechanisms may be used to hold lace 154 securely in a tightened configuration.

Figure 8:
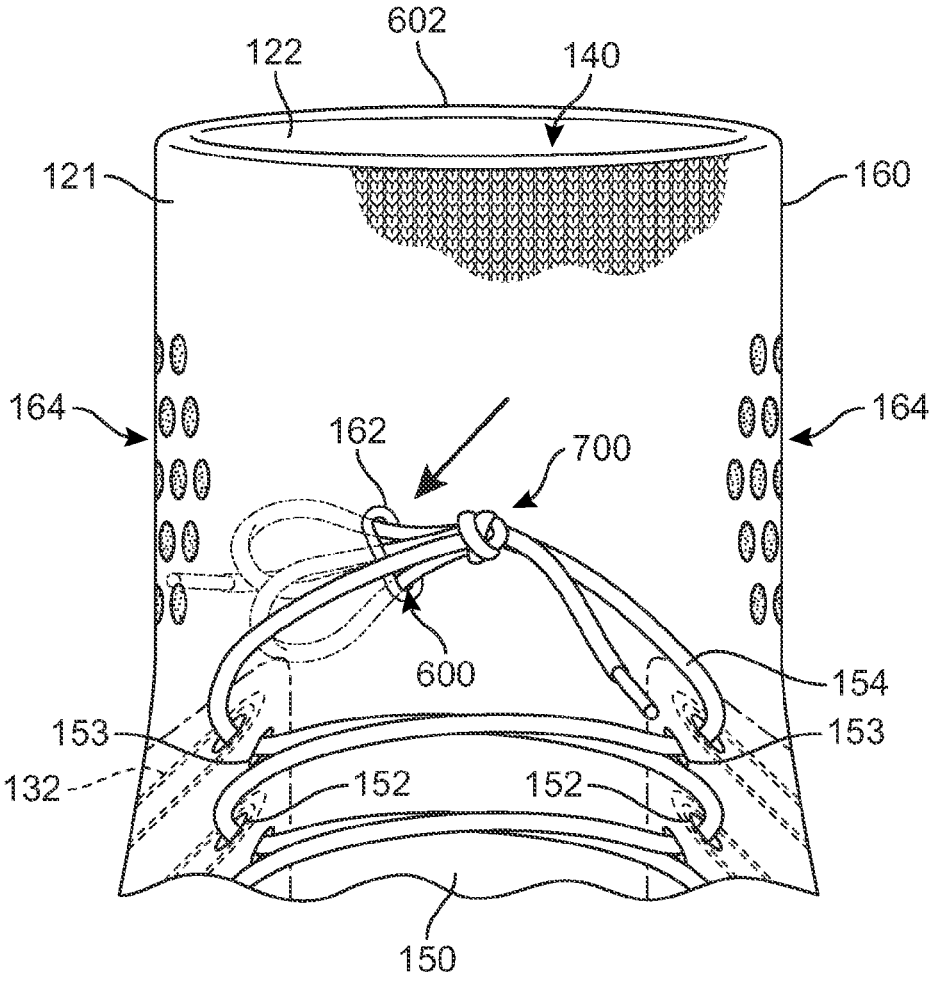
FIG. 8 is an enlarged front view of an exemplary embodiment of a knit cuff including an aperture receiving a tied lace.
Figure 9:
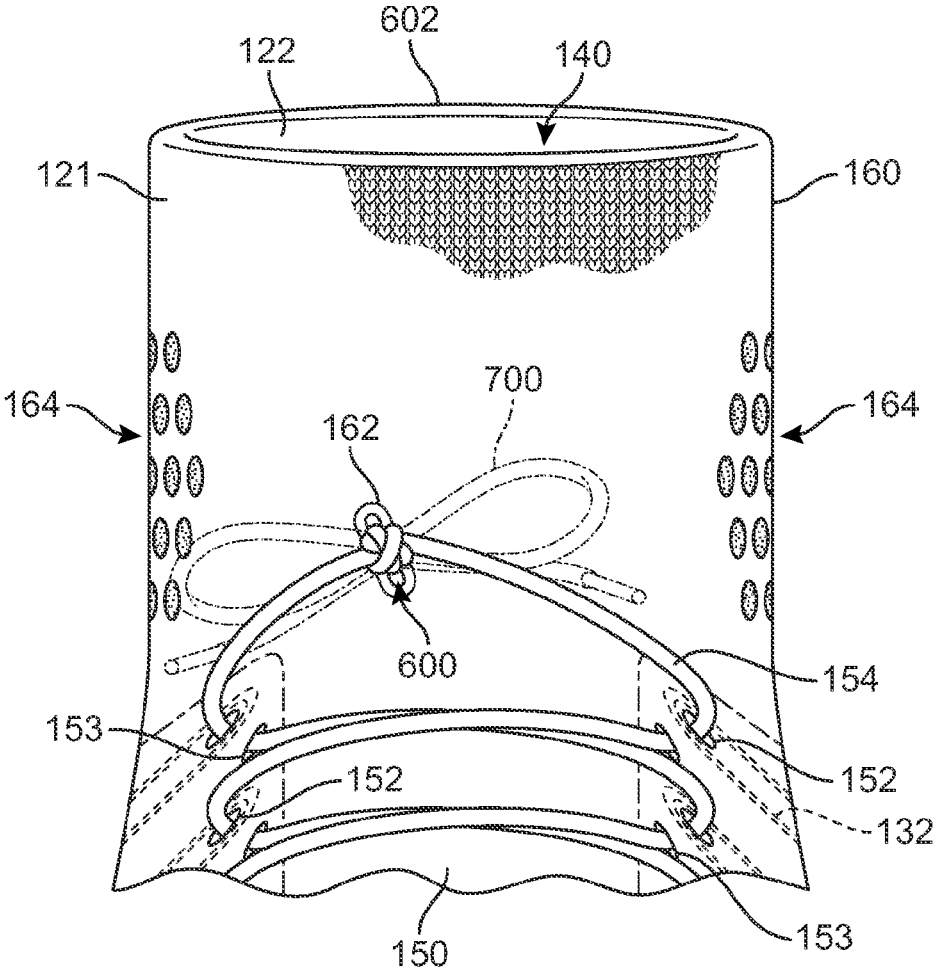
FIG. 9 is an enlarged front view of an exemplary embodiment of a knit cuff including an aperture for receiving a tied lace shown in phantom.

Next, as shown in FIG. 8, the loose ends of bow 700, including the lace loops and trailing lace ends, may begin to be disposed through hole 600 formed by tied-lace receiving aperture 162. In an exemplary embodiment, the portion of knitted component forming ankle cuff 160 and/or instep area 150 around tied-lace receiving aperture 162 may stretch to assist with tucking the loose ends of bow 700 into hole 600. Finally, as shown in FIG. 9, the loose ends of bow 700 have been fully inserted through hole 600 of tied-lace receiving aperture 162 so that the loose ends of bow 700 of lace 154 are disposed within the interior of upper 120 against interior surface 122 of knitted component 130. In this embodiment, the knot of bow 700 remains outside of hole 600 on exterior surface 121. However, in other embodiments, tied-lace receiving aperture 162 may be configured to accommodate all of bow 700, including the loose ends and the knot.

By placing the loose ends of bow 700 within hole 600 of tied-lace receiving aperture 162, the trailing ends of lace 154 and the lace loops of bow 700 are moved within upper 120 so that exterior surface 121 remains relatively uniform. This configuration helps to reduce the likelihood that the trailing ends of lace 154 and/or lace loops of bow 700 may interfere with article 100 when being worn. For example, in embodiments where article 100 is a soccer shoe, tied-lace receiving aperture 162 may be used to provide a generally uniform exterior surface 121 for kicking a soccer ball. With this configuration, the loose ends of bow 700, including the lace loops of bow 700 and/or the trailing ends of lace 154, are protected within the interior of upper 120 and may be prevented from flopping around and interfering when contacting the soccer ball.

Referring now to FIGS. 10 through 17, an exemplary embodiment of integral knit ankle cuff 160 is illustrated. In some embodiments, ankle cuff 160 may include features that are configured to correspond with the lateral and medial malleolus bones of a wearer. In one embodiment, ankle cuff 160 includes malleolus zone 164 disposed on each of lateral side 16 and medial side 18 of upper 120. An exemplary embodiment of a knit structure forming malleolus zone 164 will be described below.

In an exemplary embodiment, knit element 131 includes at least two knit layers interlocked with each other at one or more portions to form knitted component 130. In this embodiment, a first knit layer 1000 forms a majority of a first side of knitted component 130. In some embodiments, first knit layer 1000 may be associated with a majority of exterior surface 121. A second knit layer 1010 forms a majority of a second side of knitted component 130, disposed opposite to the first side. In some embodiments, second knit layer 1010 may be associated with a majority of interior surface 122.

Figure 10:
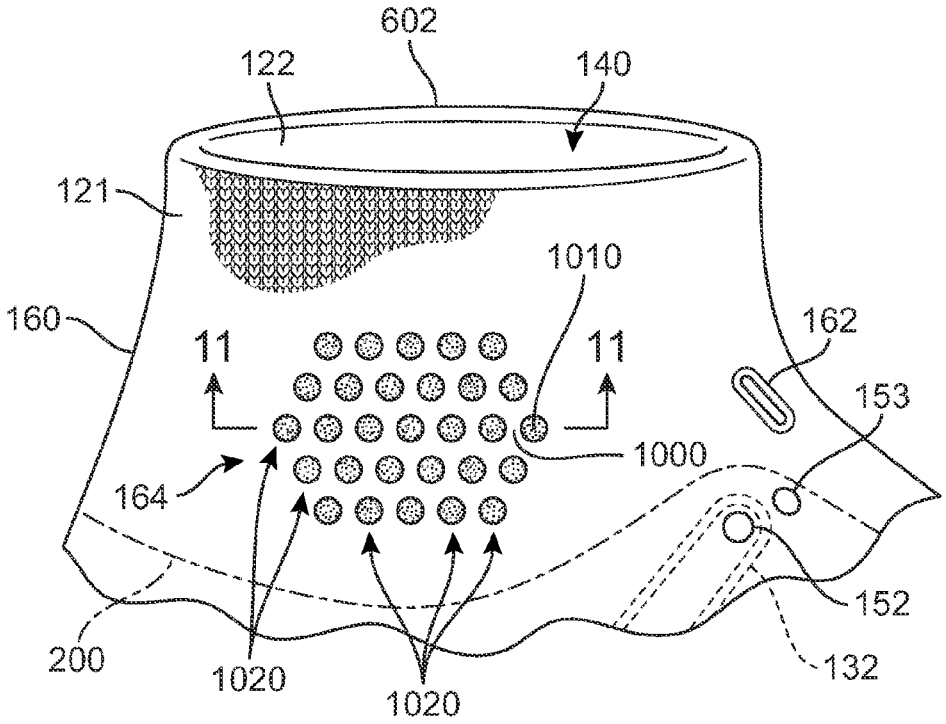
FIG. 10 is an enlarged lateral side view of a knit cuff including an exemplary embodiment of a malleolus zone.

As shown in FIG. 10, in this embodiment, malleolus zone 164 may include a plurality of indentations 1020 in exterior surface 121 of ankle cuff 160. Plurality of indentations 1020 are gaps or voids in first knit layer 1000 that allow second layer 1010 to be exposed to the exterior of knitted component 130. That is, in this embodiment, exterior surface 121 includes first knit layer 1000 and a portion of second knit layer 1010 that is disposed within the bottom of plurality of indentations 1020.

Figure 11:
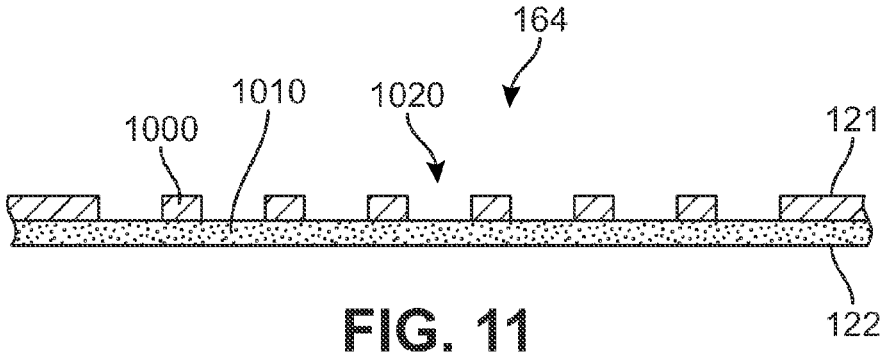
FIG. 11 is a cross-sectional view of an exemplary embodiment of a malleolus zone taken along the line shown in FIG. 10.

Referring now to FIG. 11, a cross-sectional view of malleolus zone 164 is illustrated to show the knit structure including first knit layer 1000 and second knit layer 1010. In this embodiment, each indentation of plurality of indentations 1020 has a depth that is approximately equal to the thickness of first layer 1000. By knitting knit element 131 such that first layer 1000 includes selectively placed gaps or voids, second layer 1010 may be exposed to form plurality of indentations 1020.

In some embodiments, malleolus zone 164 is formed by knitting ankle cuff 160 of knitted component 130 with a knit structure that forms plurality of indentations 1020 during the knitting process. A suitable knit structure for forming malleolus zone 164 includes a 1×1 mock mesh knit structure or 2×2 mock mesh structure. In contrast with a mesh knit structure, which may be used to form apertures that extend fully through knit element 131, including both first knit layer 1000 and second knit layer 1010, a mock mesh knit structure forms indentations in first knit layer 1000, as depicted in FIG. 11. In addition to enhancing the aesthetics of article 100, a mock mesh knit structure may enhance flexibility and decrease the overall mass of knitted component 130. In comparison with a 1×1 mock mesh knit structure, a 2×2 mock mesh knit structure forms larger indentations in first knit layer 1000. Depending on the desired size of plurality of indentations 1020 associated with malleolus zone 164, a 1×1 mock mesh knit structure or a 2×2 mock mesh knit structure may be used. In other embodiments, larger mock mesh knit structures may be similarly formed. Additionally, in other embodiments, a combination of 1×1 mock mesh knit structures, 2×2 mock mesh knit structures, or larger mock mesh knit structures may be used together to form malleolus zone 164.

Suitable mock mesh knit structures with accompanying loop diagrams for knitting such mock mesh knit structures for use in the present embodiments are described in U.S. Patent Application Publication 2012/0233882 to Huffa et al., which was referenced above and incorporated herein.

Figure 12:
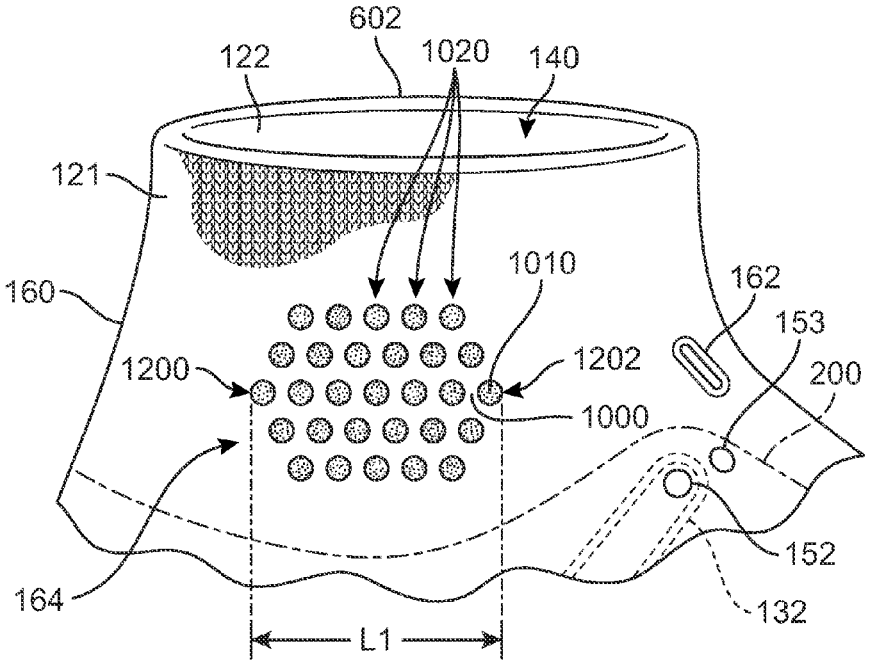
FIG. 12 is an enlarged lateral side view of a knit cuff including an exemplary embodiment of a malleolus zone.
Figure 13:
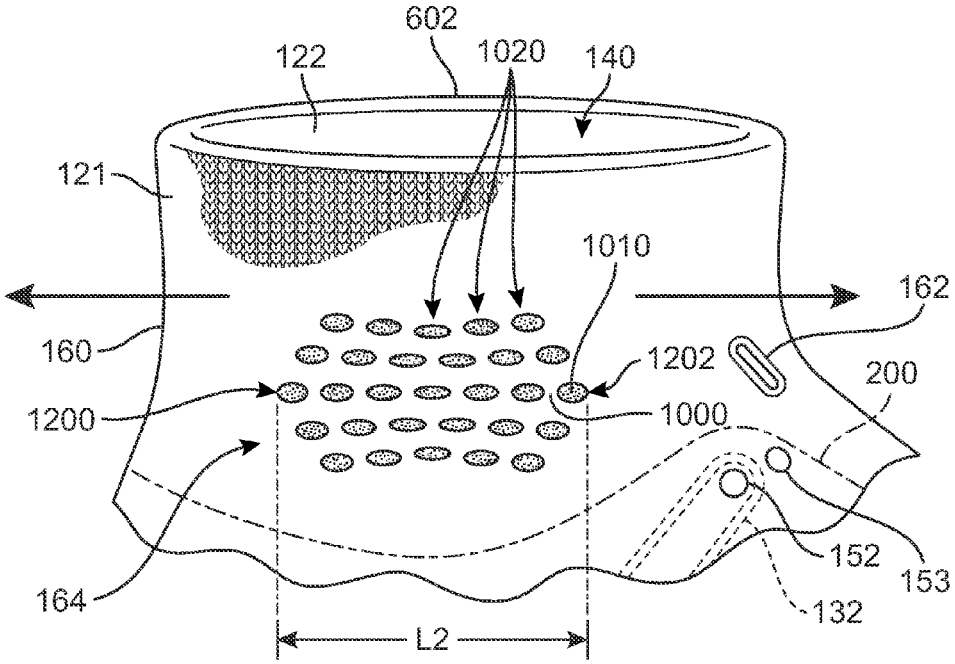
FIG. 13 is an enlarged lateral side view of a knit cuff including an exemplary embodiment of a malleolus zone undergoing stretching.

In an exemplary embodiment, malleolus zones 164 disposed on lateral side 16 and medial side 18 provide additional stretch to ankle cuff 160. As shown in FIGS. 12 and 13, ankle cuff 160 is shown undergoing stretching with malleolus zone 164. FIG. 12 illustrates an unstretched condition of ankle cuff 160. In this embodiment, malleolus zone 164 includes plurality of indentations 1020, including a first indentation 1200 and a second indentation 1202. First indentation 1200 and second indentation 1202 are disposed on opposite ends of malleolus zone 164, with first indentation 1200 disposed rearwards on ankle cuff 160 in a direction towards heel region 14 and with second indentation 1202 disposed forward on ankle cuff 160 in a direction towards forefoot region 10.

In one embodiment, first indentation 1200 and second indentation 1202 may be separated by a first length L1 on ankle cuff 160. In this embodiment, first length L1 represents the widest portion of malleolus zone 164. In other embodiments, however, malleolus zone 164 may have a different shape associated with a larger or smaller length. Additionally, in this embodiment, malleolus zone 164 is associated with plurality of indentations 1020 arranged in an approximately hexagonal-shaped configuration. However, in other embodiments, the arrangement of plurality of indentations 1020 associated with malleolus zone 164, including number and/or location of indentations, may be varied. For example, in other embodiments, the arrangement of plurality of indentations 1020 may be associated with any geometric or non-geometric shape, including circular, oval, square, triangular, rectangular, and other desired arrangements. In an exemplary embodiment, the arrangement of plurality of indentations 1020 associated with malleolus zone 164 may be chosen to approximately conform to the shape of an ankle of a wearer.

Referring now to FIG. 13, ankle cuff 160 is illustrated undergoing stretching. In one embodiment, when ankle cuff 160 is in a stretched condition, for example, as may occur when a foot is inserted within upper 120 through throat opening 140, malleolus zone 164 is configured to assist with providing stretch to ankle cuff 160. In this embodiment, first indentation 1200 and second indentation 1202 may be separated by a second length L2 on ankle cuff 160. In this embodiment, second length L2 represents a stretched condition of malleolus zone 164. Second length L2 may be larger than first length L1. In some cases, second length L2 may be significantly larger than first length L1. For example, depending on the type of knit structure used to form malleolus zone 164 and the choice of yarn type, malleolus zone 164 may undergo a significant amount of stretch compared with the remaining portion of ankle cuff 160 such that second length L2 may be at least 50% larger than first length L1. In other embodiments, second length L2 may be between 25% and 50% larger than first length L1. In still other embodiments, second length L2 may be over 50% larger than first length L1.

Figure 14:
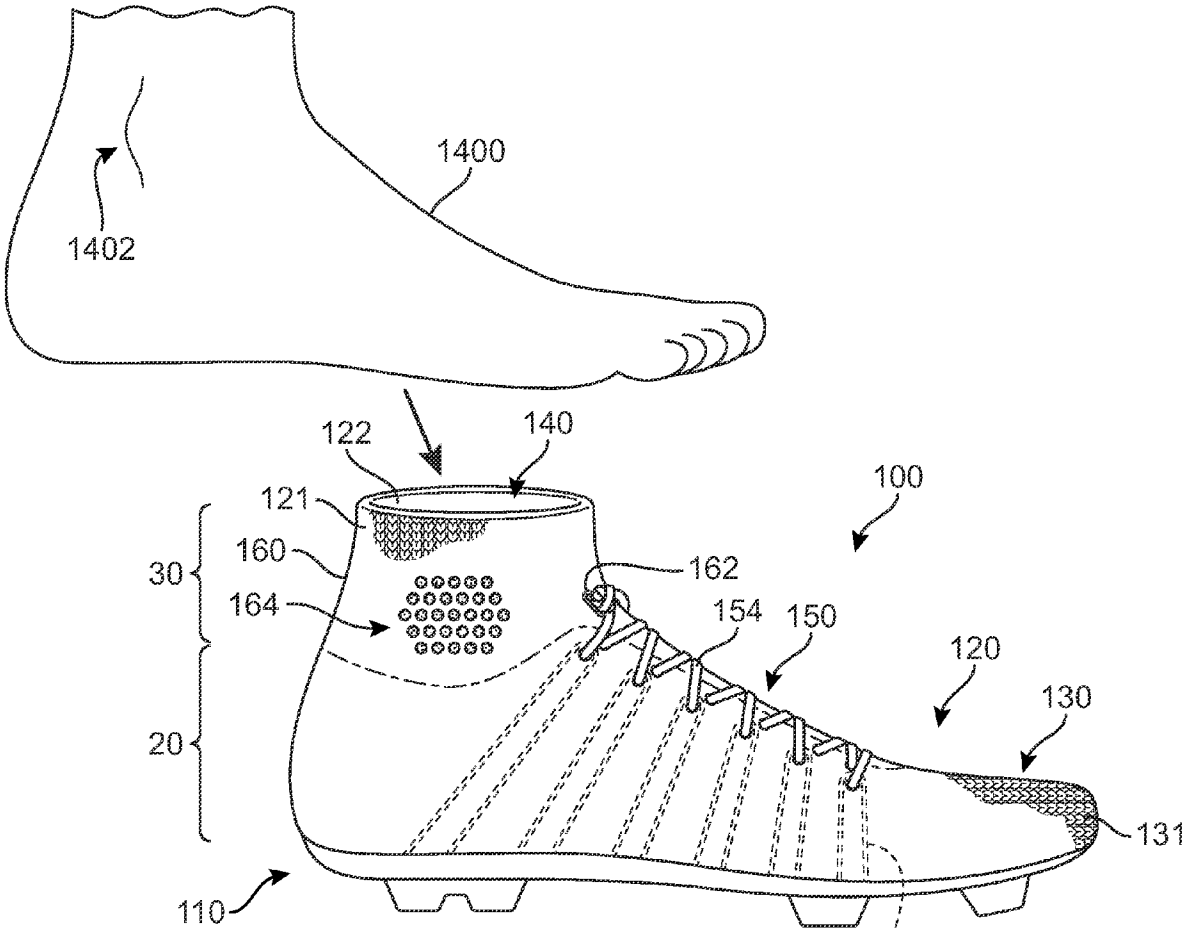
FIG. 14 is an exemplary embodiment of an article of footwear including a knit cuff with a malleolus zone.
Figure 15:
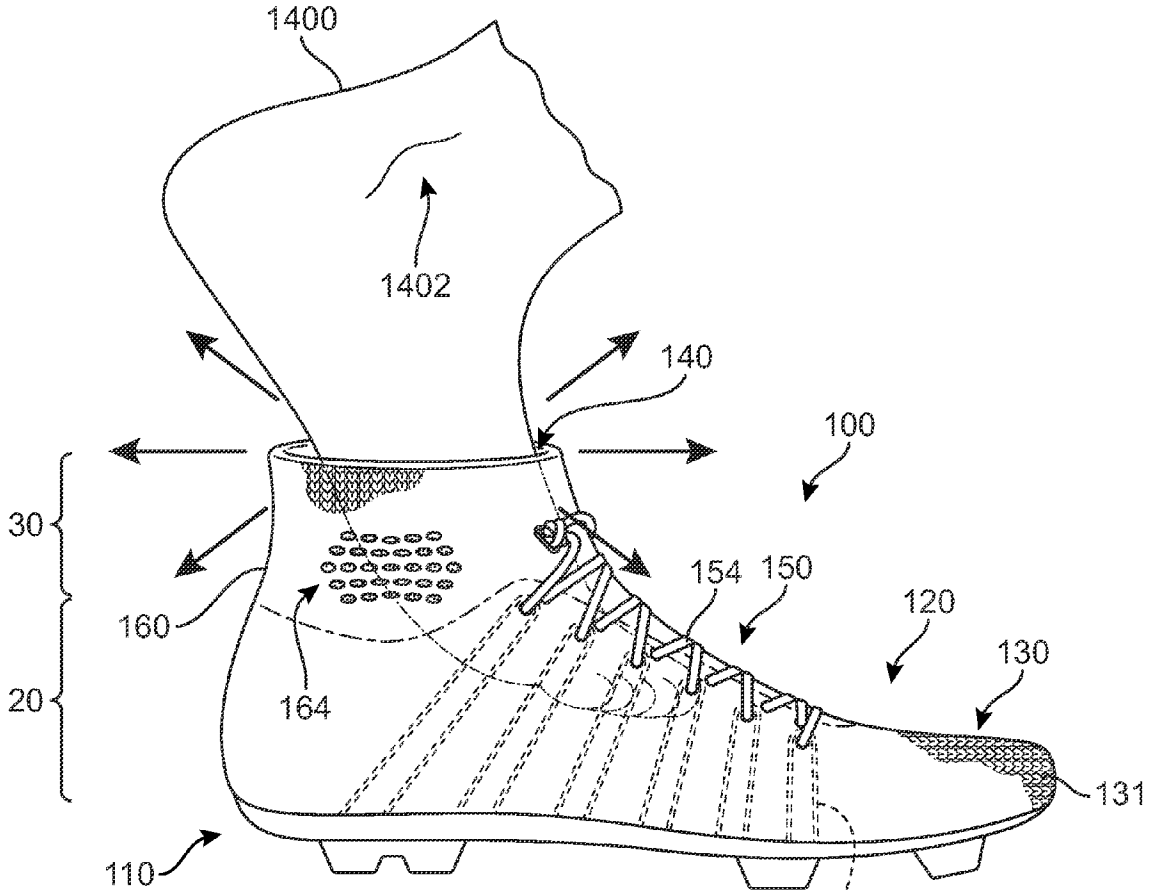
FIG. 15 is an exemplary embodiment of an article of footwear including a knit cuff with a malleolus zone having a foot of a wearer inserted.
Figure 16:
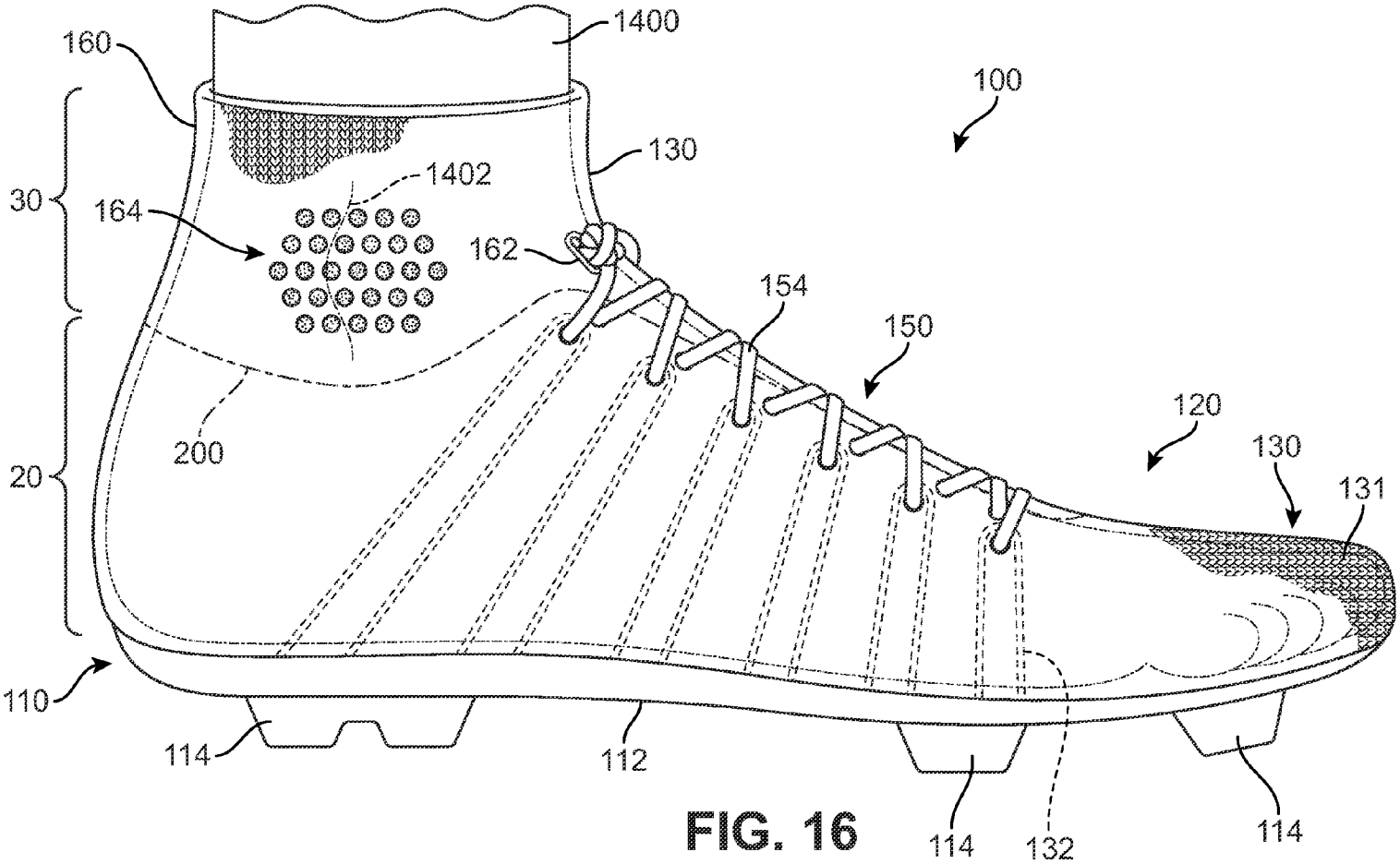
FIG. 16 is an exemplary embodiment of an article of footwear including a knit cuff with a malleolus zone with a foot of a wearer disposed inside.

FIGS. 14 through 16 illustrate an exemplary process of inserting a foot 1400 of a wearer into upper 120 of article 100 provided with ankle cuff 160 including malleolus zones 164. As shown in FIG. 14, article 100 is configured to receive foot 1400 of a wearer within the interior void of upper 120 through throat opening 140 defined by ankle cuff 160. Foot 1400 includes ankle bone 1402, also known as lateral malleolus, shown on lateral side 16. Similarly, foot 1400 further includes a medial malleolus 1404 (shown in FIG. 17) disposed opposite the lateral malleolus.

Referring now to FIG. 15, foot 1400 is shown in the process of being inserted through throat opening 140. As described above, ankle cuff 160 including malleolus zone 164 may assist with stretching ankle cuff 160 during insertion of foot 1400 within article 100. Additionally, as seen in FIG. 15, instep area 150 may also be configured to stretch, as will be further described below, to accommodate entry of foot 1400 within upper 120. FIG. 16 illustrates once foot 1400 has been inserted within upper 120 of article 100. In this embodiment, malleolus zone 164 approximately corresponds to the location of ankle bone 1402 on foot 1400. Similarly, malleolus zone 164 disposed on medial side 18 of ankle cuff 160 may also correspond to the location of medial malleolus 1404 of foot 1400. By providing ankle cuff 160 with additional stretch features, ankle cuff 160 may closely correspond and encircle foot 1400 above ankle bone 1402. With this configuration, upper 120 may tightly and securely fit foot 1400 of a wearer.

Additionally, as shown in FIG. 16, upper 120 further provides additional comfort to foot 1400 of a wearer by accommodating and allowing ankle cuff 160 to stretch at malleolus zone 164. In this embodiment, the protruding portion of ankle bone 1402 may bulge outwards of ankle cuff 160 at malleolus zone 164. With this configuration, because malleolus zone 164 may have a reduced stretch resistance than the remaining portion of ankle cuff 160, malleolus zone 164 reduces pressure on ankle bone 1402 and allows ankle cuff 160 to comfortably surround foot 1400 of a wearer.

Figure 17:
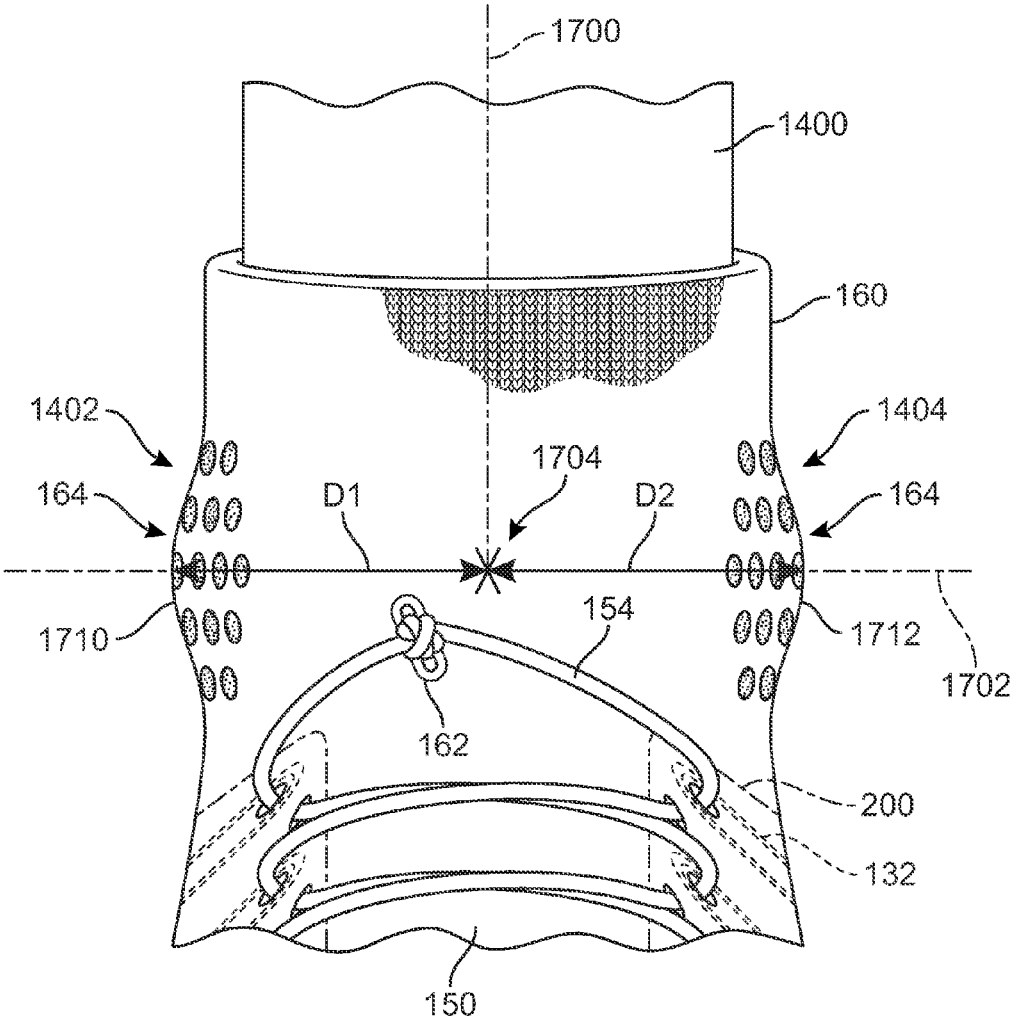
FIG. 17 is an enlarged front view of a knit cuff including a feature to assist with orientation of the upper.

Additionally, malleolus zone 164 may further assist with maintaining an orientation of upper 120 on a foot of a wearer by covering and closely fitting to the lateral and medial malleolus bones of the wearer. As shown in FIG. 17, a front view of article 100 is illustrated with foot 1400 disposed within. In this embodiment, lateral malleolus 1402 and medial malleolus 1404 are covered by malleolus zones 164 of ankle cuff 160. By allowing each of lateral malleolus 1402 and medial malleolus 1404 to bulge outwards at malleolus zones 164, ankle cuff 160 may assist with maintaining a desired orientation of upper 120.

In this embodiment, a vertical axis 1700 and a lateral axis 1702 are shown intersecting at an approximate midpoint 1704. Midpoint 1704 may located a first distance D1 from a lateral malleolus end 1710 associated with lateral malleolus 1402 of foot 1400 extending outward through malleolus zone 164 on lateral side 16 of ankle cuff 160. Similarly, midpoint 1704 may be located a second distance D2 from a medial malleolus end 1712 associated with medial malleolus 1404 of foot 1400 extending outward through malleolus zone 164 on medial side 18 of ankle cuff 160. In this embodiment, first distance D1 and second distance D2 are approximately equal such that midpoint 1704 is approximately equidistant from each of lateral malleolus end 1710 and medial malleolus end 1712.

Because the portion of ankle cuff 160 associated with each malleolus zone 164 has a smaller or reduced amount of stretch resistance than the remaining portion of ankle cuff 160, the lateral malleolus 1402 and medial malleolus 1404 of foot 1400 will tend to remain within the corresponding malleolus zone 164. With this arrangement, midpoint 1704 may remain substantially oriented in the same location on upper 120. According, upper 120 may substantially maintain a desired orientation on a foot of a wearer. For example, in embodiments where article 100 is a soccer shoe, malleolus zone 164 may assist with maintaining the orientation of upper 120 such that a generally smooth exterior surface 121 is provided for kicking a soccer ball.

In various embodiments, malleolus zone 164 having plurality of indentations 1020 may provide additional aesthetic features to ankle cuff 160. For example, by selection of yarns having different colors for each of first knit layer 1000 and second knit layer 1010, a contrasting or coordinating visual effect may be provided on ankle cuff 160. For example, team colors or user-selected choice of colored yarns forming each of first knit layer 1000 and second knit layer 1010 may be selected so that the color of second knit layer 1010 is visible on plurality of indentations 1020 of malleolus zone 164.

Figure 18:
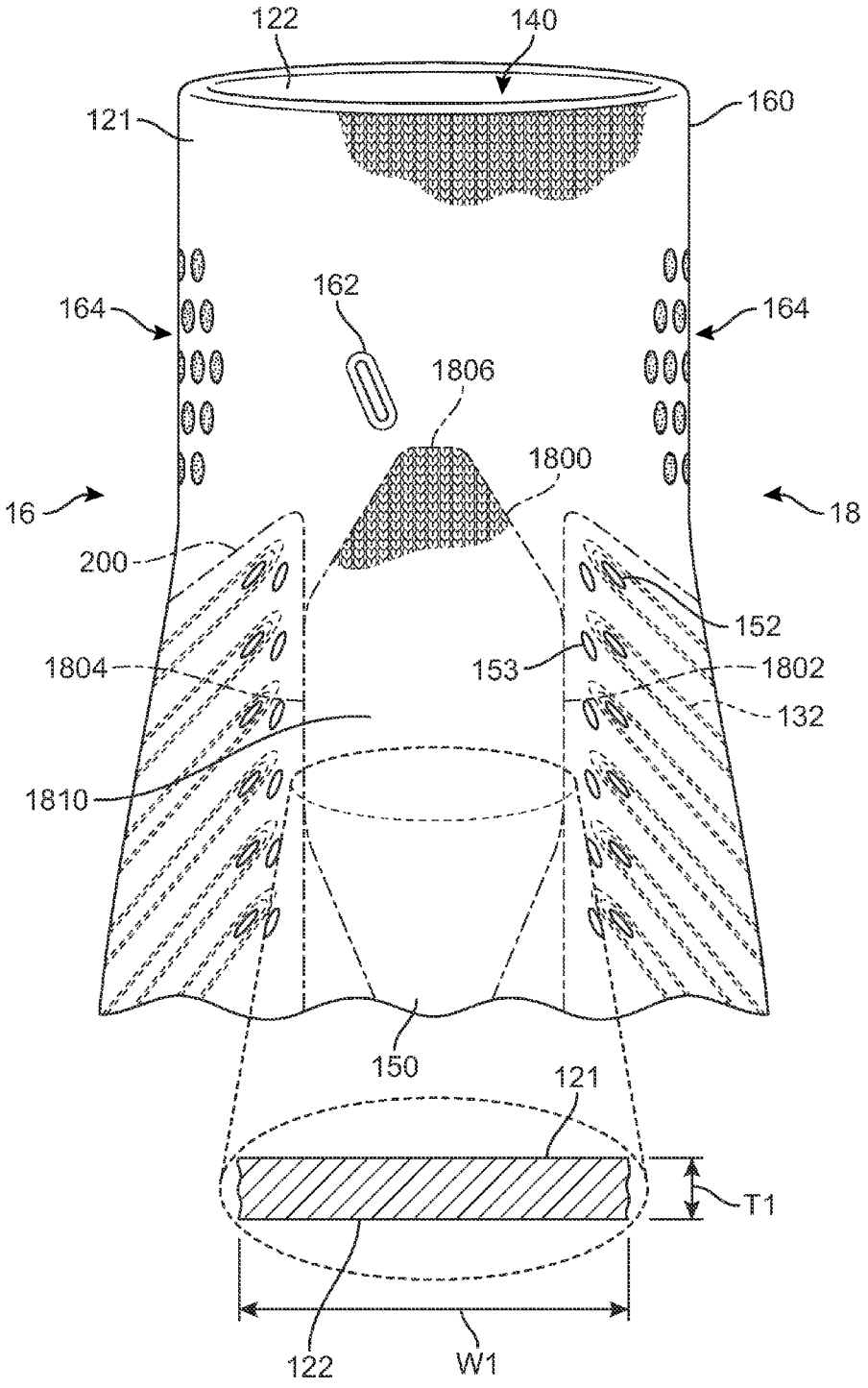
FIG. 18 is an enlarged front view of a knit cuff including an exemplary embodiment of a stretch padding zone in an non-stretched condition.
Figure 19:
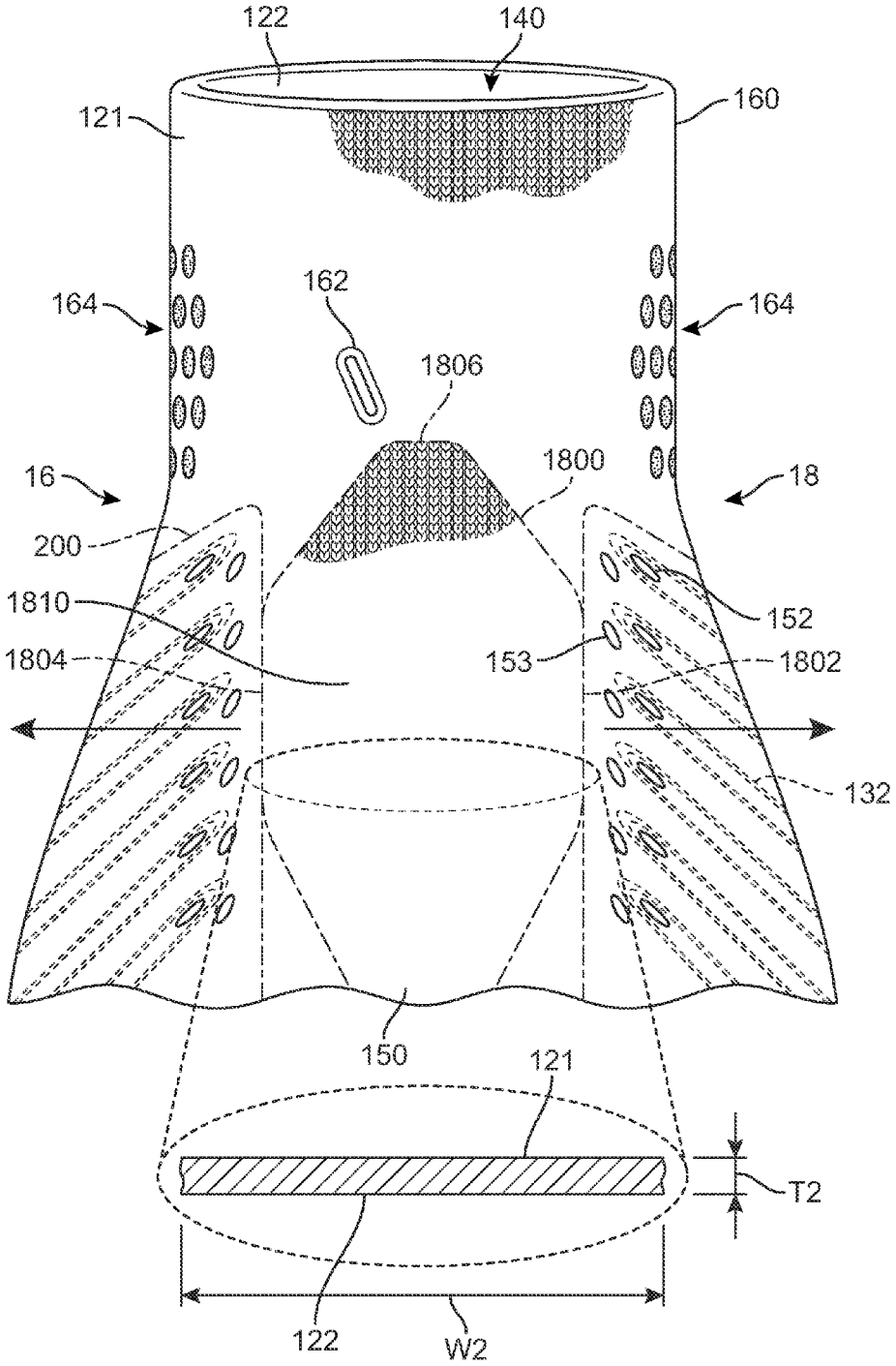
FIG. 19 is an enlarged front view of a knit cuff including an exemplary embodiment of a stretch padding zone in a stretched condition.
Figure 20:
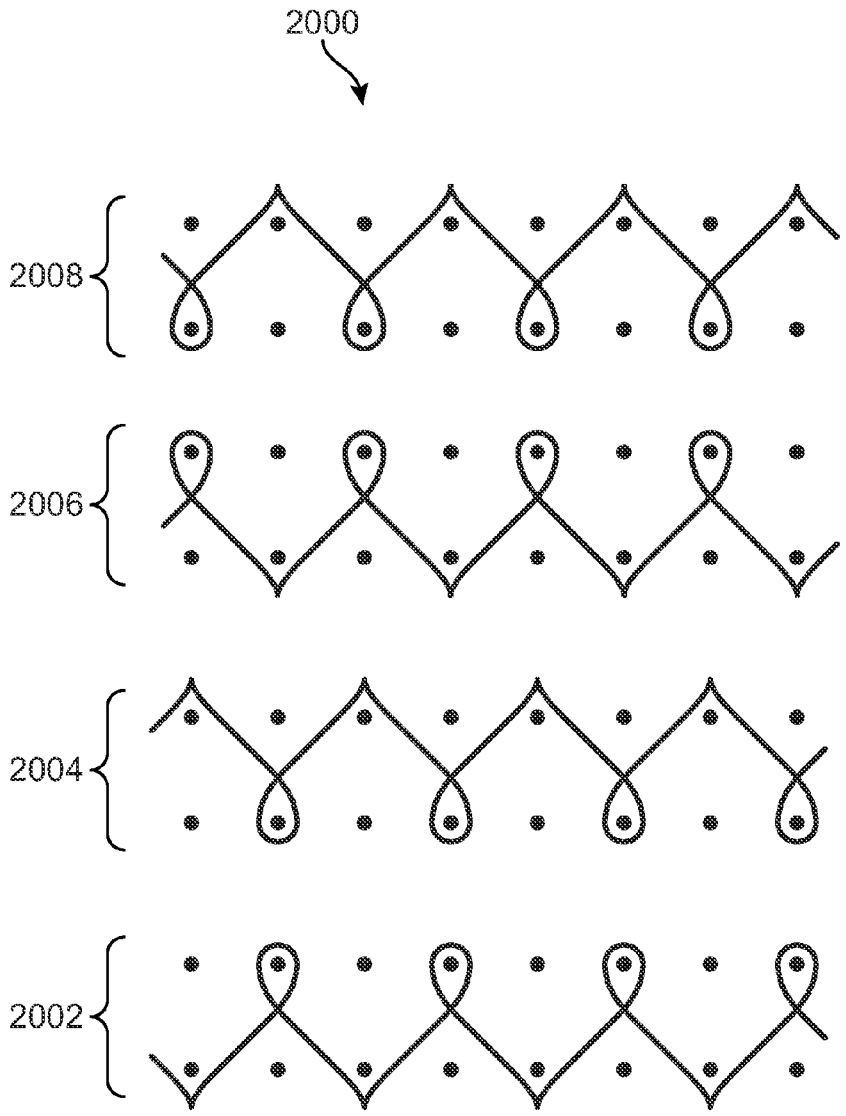
FIG. 20 is a representational view of an exemplary looping diagram for manufacturing a knitted component incorporating a stretch padding zone.

In some embodiments, knitted component 130 may include additional features on upper 120 that provide comfort and/or cushioning to a foot of a wearer. In an exemplary embodiment, knitted component 130 may include a stretch padding zone disposed in instep area 150 that is configured to stretch to assist with entry of a foot inside upper 120 and provides cushioning once the foot has been inserted. FIGS. 18 through 20 illustrate an exemplary embodiment of a stretch padding zone 1800 disposed through instep area 150 of upper 120. As shown in FIG. 18, stretch padding zone extends between lateral side 16 and medial side 18 of upper 120 from a medial edge 1802 to a lateral edge 1804 adjacent to lace apertures 152, 153 approximately in the middle of upper 120. In this embodiment, stretch padding zone 1800 may have an approximately elongated oval or diamond shape, including a top edge 1806 disposed in a direction towards throat opening 140 and a bottom edge 1808 disposed opposite top edge 1806 in a direction away from throat opening 140 towards forefoot region 10. It should be noted that although a dashed line is utilized to separate and define stretch padding zone 1800 on knitted component 130, the dashed line may be for reference only and may not correspond to any visual line on knitted component 130.

In an exemplary embodiment, stretch padding zone 1800 may be formed by knitting using a knit structure that provides cushioning in an unstretched condition and provides flexibility in a stretched condition. In one embodiment, stretch padding zone 1800 may include a stretch knit structure 1810 that is formed of unitary knit construction with the remaining portion of upper 120, including instep area 150 and ankle cuff 160. In an exemplary embodiment, stretch padding zone 1800 may be surrounded by the remaining portion of upper 120 having a different knit structure than stretch knit structure 1810. Stretch knit structure 1810 may be a knit structure that has a reduced or smaller amount of stretch resistance than the remaining portion of upper 120. For example, stretch padding zone 1800 may have stretch knit structure 1810 shown by looping diagram 2000 in FIG. 20, described below. In one embodiment, portions of upper 120 surrounding stretch padding zone 1800 may include a jersey knit structure or a double jersey knit structure. For example, stretch knit structure 1810 may be used to knit stretch padding zone 1800 such that stretch padding zone 1800 may stretch in a lateral direction from medial edge 1802 to lateral edge 1804, while remaining relatively resistant to stretch along a longitudinal direction between top edge 1806 and bottom edge 1808.

In addition, in some embodiments, the stretch properties of stretch padding zone 1800 may be further enhanced or increased by using an elastic yarn to form stretch knit structure 1810. With this configuration, the combination of reduced stretch resistance provided by stretch knit structure 1810 and the reduced stretch resistance provided by an elastic yarn may provide an increased or greater amount or degree of stretch to stretch padding zone 1800. For example, such increased or greater amount of stretch may assist a wearer with inserting a foot into upper 120.

FIG. 18 illustrates stretch padding zone 1800 in an unstretched condition. In this configuration, stretch padding zone 1800 may have a first width W1 across upper 120 between medial edge 1802 and lateral edge 1804. In addition, in the unstretched condition, stretch padding zone 1800 may have a first thickness T1 in the area of knitted component 130 between exterior surface 121 and interior surface 122. In an exemplary embodiment, first thickness T1 may be provided to assist with cushioning and/or padding an instep of a foot of a wearer of article 100. For example, in embodiments where article 100 is a soccer shoe, first thickness T1 of stretch padding zone 1800 may assist with cushioning or padding a foot of a wearer during contact with a soccer ball.

Referring now to FIG. 19, stretch padding zone 1800 is illustrated in a stretched condition. In this embodiment, upper 120 may be stretched in the lateral direction between lateral side 16 and medial side 18, for example, during entry of a foot into the interior of upper 120. In the stretched condition, stretch padding zone 1800 is configured to stretch along the lateral direction between medial edge 1802 to lateral edge 1804. In an exemplary embodiment, stretch knit structure 1810 is configured such that stretch padding zone 1800 may flatten and elongate in the lateral direction to provide flexibility for insertion of a foot within upper 120. As shown in FIG. 19, during the stretched condition, stretch padding zone 1800 may have a second width W2 across upper 120 between medial edge 1802 and lateral edge 1804. In one embodiment, second width W2 may be larger than first width W1. For example, in some cases, second width W2 may be at least 25% larger than first width W1. In other cases, second width W2 may be from 25% to 50% larger than first width W1. In still other cases, second width W2 may be more than 50% larger than first width W1.

In addition, in the stretched condition, stretch padding zone 1800 may have a second thickness T2 in the area of knitted component 130 between exterior surface 121 and interior surface 122. In an exemplary embodiment, second thickness T2 may smaller than first thickness T1. Once the stretched condition is finished and stretch padding zone 1800 returns back to the unstretched condition, stretch padding zone 1800 will again have first thickness T1 in the area of knitted component 130. With this configuration, stretch padding zone 1800 may assist with inserting a foot of a wearer into upper 120 while providing cushioning and/or padding to the instep of the foot once it has been inserted.

Referring now to FIG. 20, an exemplary embodiment of a looping diagram 2000 for knitting stretch knit structure 1810 is illustrated. In this embodiment, looping diagram 2000 illustrates the sequence of stitches and movements performed by a knitting machine, for example, a flat-knitting machine, to form stretch knit structure 1810 making up a portion of stretch padding zone 1800. As shown in FIG. 20, the spaced apart dots represent the needles of a knitting machine and the illustrated steps represent the direction of movement of a yarn or thread between the needles of each of a front bed and a back bed of a knitting machine. In a first step 2002, a yarn or thread is passed in an alternating manner between each of the front bed and the back bed, with knit stitches performed on the back bed and tuck stitches on the front bed.

Next, in a second step 2004, the yarn or thread passes in an alternating manner between the front bed and back bed with knit stitches performed on the front bed at needles disposed in between the needles having tuck stitches performed in first step 2002. Similarly, in second step 2004, tuck stitches are performed on the back bed at needles disposed in between the needles having knit stitches performed in first step 2002. At a third step 2006, knit stitches are performed on the back bed on the same needles that are holding the yarn or thread from tuck stitches performed in second step 2004. Additionally, in third step 2006, tuck stitches are performed on the front bed on the same needles as the needles that had knit stitches performed in second step 2004.

Finally, in a fourth step 2008, the yarn or thread is knit stitched on the same needles on front bed as the tuck stitches performed in first step 2002 and the yarn or thread is tuck stitched on the same needles on back bed as the knit stitches performed in first step 2002. With this configuration, a portion of stretch padding zone 1800 with stretch knit structure 1810 may be formed.

It should be understood that portion of stretch padding zone 1800 that may be made with stretch knit structure 1810 according to looping diagram 2000 illustrated in FIG. 20 is merely exemplary. A stretch padding zone 1800 having desired dimensions may be formed using a substantially similar process shown in looping diagram 2000 to knit a knit structure having a width associated with a selected number of stitches and a length associated with a selected number of courses.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear having an upper and a sole structure secured to the upper, the upper including a knitted component, the knitted component including:

a foot region forming a majority of the upper, the foot region extending through a forefoot region, a midfoot region, and a heel region of the article of footwear, the foot region including an instep area that extends between a medial side and a lateral side of the upper;

a plurality of lace apertures configured to receive a lace, the plurality of lace apertures being disposed in a longitudinal direction along the upper on each of the medial side and the lateral side of the instep area;

wherein at least two of the plurality of lace apertures on the medial side are disposed in a pair that are offset from each other in the longitudinal direction and wherein at least two of the plurality of lace apertures on the lateral side are disposed in a pair that are offset from each other in the longitudinal direction;

an ankle region forming a portion of the upper that extends above the foot region, the ankle region including an ankle cuff that defines a throat opening to a void within the upper that is configured to receive a foot;

wherein the ankle cuff is formed of unitary knit construction with at least the instep area of the foot region and a portion of the foot region disposed on the medial side and lateral side in the heel region;

wherein the ankle cuff further comprises at least one malleolus zone disposed on at least one of the medial side and the lateral side of the upper, the at least one malleolus zone being disposed at a location that is configured to correspond to at least one of a medial malleolus bone and a lateral malleolus bone of a foot of a wearer, and the at least one malleolus zone including a plurality of indentations in a first knit layer comprising an exterior surface of the ankle cuff; and wherein the at least one malleolus zone includes a first knit structure and a remaining portion of the ankle cuff includes a second knit structure, the first knit structure being different than the second knit structure; and wherein the knitted component further comprises a tied-lace receiving aperture formed into at least one of the instep area and the ankle cuff, and wherein the tied-lace receiving aperture defines an opening, the opening being larger than openings in a knit structure surrounding the tied-lace receiving aperture and the tied-lace receiving aperture is configured to receive loose ends of a tied lace within an interior of the upper and wherein the tied-lace receiving aperture is located above a top-most set of lace apertures and off-center towards a lateral side of the footwear.

2. The article of footwear according to claim 1, wherein the ankle cuff comprises at least two knit layers; and wherein the first knit layer comprises a majority of the exterior surface of the ankle cuff and a second knit layer comprises a majority of an interior surface of the ankle cuff.

3. The article of footwear according to claim 2, wherein the plurality of indentations are formed by voids in the first knit layer that expose the second knit layer.

4. The article of footwear according to claim 3, wherein the voids in the first knit layer comprise at least one of a 1×1 mock mesh knit structure and a 2×2 mock mesh knit structure.

5. The article of footwear according to claim 1, wherein the plurality of indentations is arranged in a hexagonal-shape.

6. The article of footwear according to claim 1, wherein the instep area further comprises a stretch padding zone disposed between the medial side and the lateral side of the upper along a top portion of the article of footwear;

the stretch-padding zone being configured to stretch in a lateral direction across the article of footwear between an unstretched condition and a stretched condition; and wherein the stretch padding zone has a first thickness in the unstretched condition and a second thickness in the stretched condition, the first thickness being larger than the second thickness.

7. The article of footwear of claim 1 wherein the lace passes through at least one aperture of the pair of apertures on the medial side, extends under the knitted component, and exits the knitted component through the other aperture of the pair of apertures on the medial side.

8. The article of footwear of claim 1 wherein the lace passes through at least one aperture of the pair of apertures on the lateral side, extends under the knitted component, and exits the knitted component through the other aperture of the pair of apertures on the lateral side.

9. An article of footwear having an upper and a sole structure secured to the upper, the upper including a knitted component, the knitted component including:

a foot region forming a majority of the upper, the foot region extending through a forefoot region, a midfoot region, and a heel region of the article of footwear, the foot region including an instep area that extends between a medial side and a lateral side of the upper;

a plurality of lace apertures configured to receive a lace, the plurality of lace apertures being disposed in a longitudinal direction along the upper on each of the medial side and the lateral side of the instep area;

wherein at least two of the plurality of lace apertures on the medial side are disposed in a pair that are offset from each other in the longitudinal direction and wherein at least two of the plurality of lace apertures on the lateral side are disposed in a pair that are offset from each other in the longitudinal direction;

an ankle region forming a portion of the upper that extends above the foot region, the ankle region including an ankle cuff that defines a throat opening to a void within the upper that is configured to receive a foot;

the instep area further including a stretch padding zone surrounded by and formed of unitary knit construction with the instep area, the stretch padding zone being disposed between the medial side and the lateral side of the upper along a top portion of the article of footwear;

the stretch adding zone being configured to stretch in a lateral direction across the article of footwear between an unstretched condition and a stretched condition;

wherein the stretch padding zone is formed by a first knit structure and a remaining portion of the instep area being formed by a second knit structure, the first knit structure being different than the second knit structure; and wherein the stretch padding zone has a first thickness in the unstretched condition and a second thickness in the stretched condition, the first thickness being larger than the second thickness wherein the ankle cuff further comprises at least one malleolus zone disposed on at least one of the medial side and the lateral side of the upper, the at least one malleolus zone including a plurality of indentations in an exterior surface of the ankle cuff and wherein the at least one malleolus zone includes a first knit structure and a remaining portion of the ankle cuff includes a second knit structure, the first knit structure being different than the second knit structure;

wherein the knitted component further comprises a tied-lace receiving aperture formed into at least one of the instep area and the ankle cuff, and wherein the tied-lace receiving aperture defines an opening, the opening being larger than openings in a knit structure surrounding the tied-lace receiving aperture and the tied-lace receiving aperture is configured to receive loose ends of a tied lace within an interior of the upper and wherein the tied-lace receiving aperture is located above a top-most set of lace apertures and off-center towards a lateral side of the footwear.

10. The article of footwear according to claim 9, wherein the stretch padding zone defines an elongated diamond shape.

11. The article of footwear according to claim 9, wherein the second knit structure includes at least one of a jersey knit structure and a double jersey knit structure.

12. The article of footwear according to claim 9, wherein the stretch padding zone extends between the plurality of lace apertures on each of the medial side and the lateral side of the instep area.

13. The article of footwear according to claim 9, wherein the stretch padding zone is formed of unitary knit construction with the ankle cuff such that the stretch padding zone includes at least one course in common with the ankle cuff.

14. The article of footwear according to claim 9, wherein the ankle cuff is formed of unitary knit construction with at least the instep area of the foot region and a portion of foot region disposed on the medial side and lateral side in the heel region.

15. An article of footwear having an upper and a sole structure secured to the upper, the upper including a knitted component, the knitted component including:

a foot region forming a majority of the upper, the foot region extending through a forefoot region, a midfoot region, and a heel region of the article of footwear, the foot region including an instep area that extends between a medial side and a lateral side of the upper;

a plurality of lace apertures configured to receive a lace, the plurality of lace apertures being disposed in a longitudinal direction along the upper on each of the medial side and the lateral side of the instep area;

wherein at least two of the plurality of lace apertures on the medial side are disposed in a pair that are offset from each other in the longitudinal direction and wherein at least two of the plurality of lace apertures on the lateral side are disposed in a pair that are offset from each other in the longitudinal direction;

an ankle region forming a portion of the upper that extends above the foot region, the ankle region including an ankle cuff that defines a throat opening to a void within the upper that is configured to receive a foot;

wherein the knitted component further comprises a tied-lace receiving aperture formed into at least one of the instep area and the ankle cuff, and wherein: the tied-lace receiving aperture defines an opening, the opening being larger than openings in a knit structure surrounding the tied-lace receiving aperture; wherein the tied-lace receiving aperture is configured to receive loose ends of a tied lace within an interior of the upper and wherein the tied-lace receiving aperture is located above a top-most set of lace apertures and off-center towards a lateral side of the footwear; and wherein the ankle cuff further comprises at least one malleolus zone disposed on at least one of the medial side and the lateral side of the upper, the at least one malleolus zone including a plurality of indentations in an exterior surface of the ankle cuff and wherein the at least one malleolus zone includes a first knit structure and a remaining portion of the ankle cuff includes a second knit structure, the first knit structure being different than the second knit structure.

16. The article of footwear according to claim 15, wherein the knitted component comprises a knit element having two sides, including a first side forming a majority of an exterior surface of the upper and a second side disposed opposite the first side, the second side forming a majority of an interior surface disposed within the interior of the upper;

wherein the tied-lace receiving aperture defines a hole that extends through the first side and the second side of the knit element; and wherein the loose ends of the tied lace are configured to rest along the interior surface within the interior of the upper when disposed through the hole of the tied-lace receiving aperture.

17. The article of footwear according to claim 15, wherein the tied-lace receiving aperture comprises a button-hole stitch in the knitted component.

18. The article of footwear according to claim 15, wherein the ankle cuff is formed of unitary knit construction with at least the instep area of the foot region and a portion of foot region disposed on the medial side and lateral side in the heel region.

19. The article of footwear according to claim 15, wherein the instep area further comprises a stretch padding zone disposed between the medial side and the lateral side of the upper along a top portion of the article of footwear;

the stretch padding zone being configured to stretch in a lateral direction across the article of footwear between an unstretched condition and a stretched condition; and wherein the stretch padding zone has a first thickness in the unstretched condition and a second thickness in the stretched condition, the first thickness being larger than the second thickness.

20. The article of footwear according to claim 9, wherein the first knit structure includes a knit structure formed by alternating knit and tuck stitches on both a front needle bed and a back needle bed of a flat knitting machine.

* * * * *